US010892554B2

(12) United States Patent
Yamada et al.

(10) Patent No.: US 10,892,554 B2
(45) Date of Patent: Jan. 12, 2021

(54) ANTENNA ELEMENT, ANTENNA MODULE, AND COMMUNICATION DEVICE

(71) Applicant: Murata Manufacturing Co., Ltd., Kyoto (JP)

(72) Inventors: Yoshiki Yamada, Kyoto (JP); Kaoru Sudo, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 16/890,302

(22) Filed: Jun. 2, 2020

(65) Prior Publication Data

US 2020/0295463 A1 Sep. 17, 2020

Related U.S. Application Data

(63) Continuation of application No. PCT/JP2019/032248, filed on Aug. 19, 2019.

(30) Foreign Application Priority Data

Aug. 20, 2018 (JP) ..... 2018-153806

(51) Int. Cl.
*H01Q 1/38* (2006.01)
*H01Q 9/04* (2006.01)
(Continued)

(52) U.S. Cl.
CPC ..... *H01Q 9/0407* (2013.01); *H01Q 3/26* (2013.01); *H01Q 5/35* (2015.01)

(58) Field of Classification Search
CPC ..... H01Q 9/0407; H01Q 5/35; H01Q 3/26; H01Q 13/08; H01Q 21/08; H01Q 5/10; H01Q 25/00
See application file for complete search history.

(56) References Cited

U.S. PATENT DOCUMENTS 3,680,136 A * 7/1972 Collings ..... H01Q 9/0407 343/746
9,865,928 B2 * 1/2018 Sudo ..... H01Q 5/378
2019/0020110 A1 * 1/2019 Paulotto ..... H01Q 19/005

FOREIGN PATENT DOCUMENTS

CN 108336491 A 7/2018
JP S58-59604 A 4/1983
(Continued)

OTHER PUBLICATIONS

International Search Report for International Application No. PCT/JP2019/032248 dated Oct. 1, 2019.
(Continued)

*Primary Examiner* — Dieu Hien T Duong
(74) *Attorney, Agent, or Firm* — Pearne & Gordon LLP

(57) ABSTRACT

A patch antenna includes a ground conductor pattern, feeding conductor patterns (11, 12), and a feed line (15). The feeding conductor patterns (11, 12) are disposed on the same side with respect to the ground conductor pattern and are of different sizes. The feeding conductor pattern (11) has feed points (111, 112) for direct feeding through the feed line. The feeding conductor pattern (12) has a feed point (121) for direct feeding through the feed line and a feed point (122) for capacitive feeding through the feed line. The feed points (111, 112) are opposite to each other with respect to a center point of the feeding conductor pattern (11). The feed points (121, 122) are opposite to each other with respect to a center point of the feeding conductor pattern (12).

16 Claims, 9 Drawing Sheets

(51) Int. Cl.
*H01Q 5/35* (2015.01)
*H01Q 3/26* (2006.01)

(56) References Cited

FOREIGN PATENT DOCUMENTS

| | | | |
|---|---|---|---|
| JP | H0823221 | A | 1/1996 |
| JP | 2004-215245 | A | 7/2004 |
| JP | 2005-198335 | A | 7/2005 |
| JP | 2005-323250 | A | 11/2005 |

OTHER PUBLICATIONS

Written Opinion for International Application No. PCT/JP2019/032248 dated Oct. 1, 2019.

* cited by examiner

ANTENNA ELEMENT, ANTENNA MODULE, AND COMMUNICATION DEVICE

This is a continuation of International Application No. PCT/JP2019/032248 filed on Aug. 19, 2019 which claims priority from Japanese Patent Application No. 2018-153806 filed on Aug. 20, 2018. The contents of these applications are incorporated herein by reference in their entireties.

BACKGROUND

Technical Field

The present disclosure relates to an antenna element, an antenna module, and a communication device.

A microstrip antenna disclosed in Patent Document 1 is an example of antennas for radio communications. The microstrip antenna disclosed in Patent Document 1 includes a substrate, a conductor pattern (an antenna element), and a dielectric sandwiched between the substrate and the conductor pattern. The conductor pattern has two feed points, namely, a feed point A and a feed point B, which are arranged symmetrically about a center point. A power distributor feeds, to the feed point A, power with a phase of 0° and a predetermined amplitude. The power distributor feeds, to the feed point B, power with a phase of 180° and a predetermined amplitude. This structure conceivably enables the conductor pattern to radiate linearly polarized waves with good directivity owing to enhanced excitation of a desired mode and to elimination of higher-order modes that are unwanted as opposed to the desired mode.

Patent Document 1: Japanese Unexamined Patent Application Publication No. 58-59604

BRIEF SUMMARY

It is required that the microstrip antenna described in Patent Document 1 be equipped with a pair of feed lines, or more specifically, a first feed line forming a connection between the power distributor and the feed point A and a second feed line forming a connection between the power distributor and the feed point B. Moreover, radiating radio waves in a plurality of communication bands (a plurality of frequency bands) to support radio communications with multi-band features requires a conductor pattern and feed lines that are geared to the feeding of radio-frequency signals with a phase of 0° and radio-frequency signals with a phase of 180° in the individual frequency bands from the power distributor. The coverage of more communication bands (frequency bands) involves an increase in the number of feed lines, which in turn necessitate complex wiring. Thus, such a microstrip antenna may be large.

The present disclosure provides a compact antenna element that enables radiation of radio waves in a plurality of frequency bands while achieving good directivity and a high level of cross-polarization discrimination.

An antenna element according to an aspect of the present disclosure includes: a ground conductor lying in a plane and set to ground potential; a first feeding conductor lying in a plane and disposed in a manner so as to face the ground conductor; a second feeding conductor lying in a plane and disposed in a manner so as to face the ground conductor; and a first feed line through which radio-frequency signals are transmitted to the first and second feeding conductors. The first and second feeding conductors are disposed on the same side with respect to the ground conductor and are of different sizes. The first feeding conductor has a first feed point for direct feeding through the first feed line and a second feed point for direct feeding through the first feed line. The second feeding conductor has a third feed point for direct feeding through the first feed line and a fourth feed point for capacitive feeding through the first feed line. The second feed point is opposite to the first feed point with respect to a center point of the first feeding conductor when the first feeding conductor is viewed in plan. The fourth feed point is opposite to the third feed point with respect to a center point of the second feeding conductor when the second feeding conductor is viewed in plan.

The present disclosure provides a compact antenna element that enables radiation of radio waves in a plurality of frequency bands while achieving good directivity and a high level of cross-polarization discrimination.

DETAILED DESCRIPTION

Figure 1:
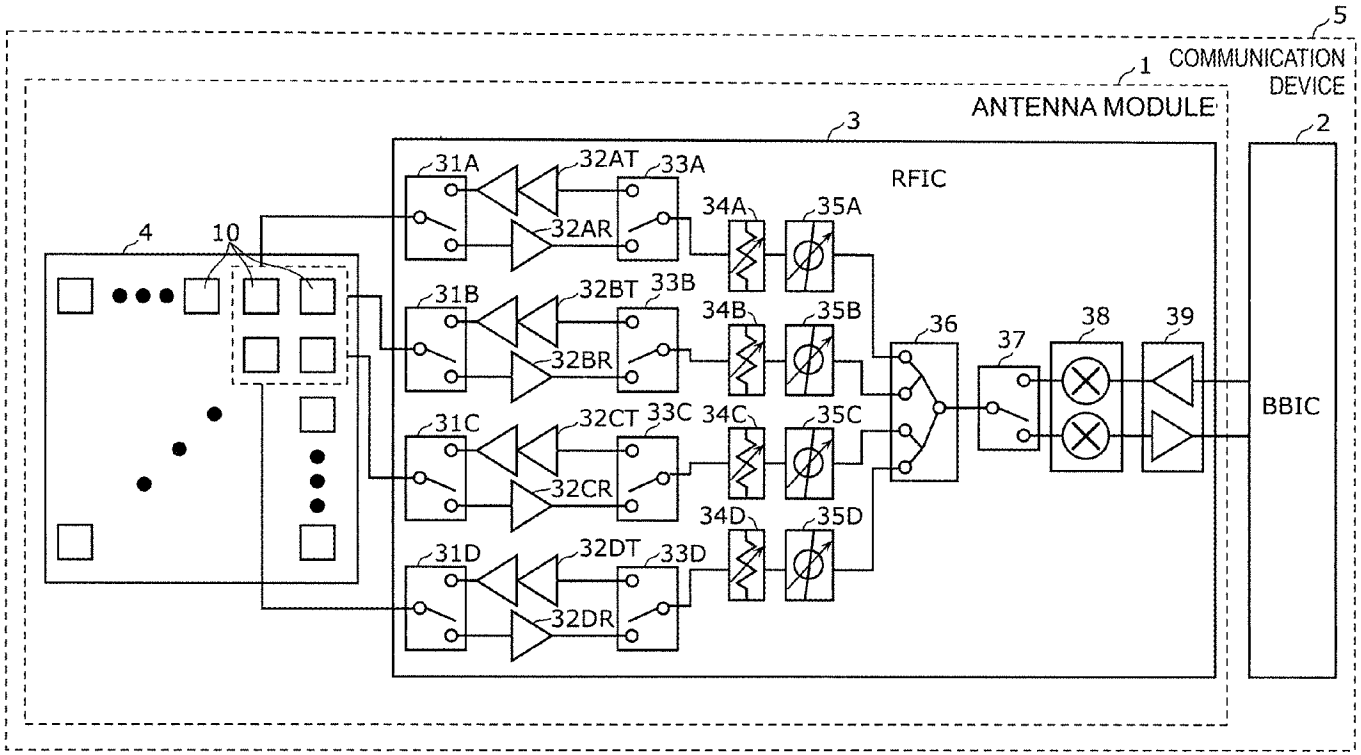
FIG. 1 is a circuit diagram illustrating a communication device (an antenna module) according to Embodiment 1 and peripheral circuitry.

Hereinafter, embodiments of the present disclosure will be described in detail with reference to the drawings. The following embodiments are general or specific examples. Details, such as values, shapes, materials, constituent components, and arrangements and connection patterns of the constituent components in the following embodiments are provided merely as examples and should not be construed as limiting the present disclosure. Of the constituent components in the following embodiments, constituent components that are not mentioned in independent claims are described as optional constituent components. The sizes and the relative proportions of the constituent components illustrated in the drawings are not necessarily to scale.

Embodiment 1

[1.1 Circuit Configuration of Communication Device (Antenna Module)]

FIG. 1 is a circuit diagram of a communication device 5 according to Embodiment 1. The communication device 5 illustrated in the drawing includes an antenna module 1 and a baseband signal processing circuit (BBIC) 2. The antenna module 1 includes an array antenna 4 and a radio-frequency (RF) signal processing circuit (RFIC) 3. The communication device 5 up-converts signals transmitted from the baseband signal processing circuit (BBIC) 2 to the antenna module 1 and radiates resultant radio-frequency signals from the array antenna 4. The communication device 5 down-converts radio-frequency signals received through the array antenna 4, and resultant signals are processed in the baseband signal processing circuit (BBIC) 2.

The array antenna 4 includes a plurality of patch antennas 10 in two-dimensional arrangement. Each patch antenna 10 is an antenna element that functions as a radiating element configured to radiate radio waves (radio-frequency signals) and as a receiving element configured to receive radio waves (radio-frequency signals) and has principal features of the present disclosure. In the present embodiment, the array antenna 4 may be configured as a phased-array antenna.

Each patch antenna 10 has a compact structure that enables a radiating element (feeding conductors) to radiate linearly polarized waves with good directivity in a plurality of communication bands (a plurality of frequency bands). More specifically, each patch antenna 10 includes: a dielectric layer; a ground conductor lying in a plane, provided on the dielectric layer, and set to ground potential; a first feeding conductor lying in a plane and disposed on the dielectric layer in a manner so as to face the ground conductor, the first feeding conductor being configured to be fed with radio-frequency signals; a second feeding conductor lying in a plane and disposed in the dielectric layer in a manner so as to face the ground conductor, the second feeding conductor being configured to be fed with radio-frequency signals; and a first feed line through which radio-frequency signals are transmitted to the first and second feeding conductors. The first feeding conductor has a first feed point for direct feeding through the first feed line and a second feed point for direct feeding through the first feed line. The second feeding conductor has a third feed point for direct feeding through the first feed line and a fourth feed point for capacitive feeding through the first feed line. The second feed point is opposite to the first feed point with respect to the center point of the first feeding conductor when the first feeding conductor is viewed in plan. The fourth feed point is opposite to the third feed point with respect to the center point of second feeding conductor when the second feeding conductor is viewed in plan. Radio-frequency signals lying in a first frequency band and being substantially in antiphase to each other are respectively transmitted to the first and second feed points through the first feed line. Radio-frequency signals lying in a second frequency band different from the first frequency band and being substantially in antiphase to each other are respectively transmitted to the third and fourth feed points through the first feed line. The patch antenna 10 may thus be a compact antenna element that enables radiation of radio waves in two different frequency bands while achieving good symmetry of directivity and a high level of cross-polarization discrimination.

The array antenna 4 includes a plurality of patch antenna 10 in one-dimensional or two-dimensional arrangement. The dielectric layer and the ground conductor pattern are shared by the patch antennas 10.

The patch antennas 10 may be made of sheet metal instead of including the dielectric layer. The patch antennas 10 constituting the array antenna 4 may be provided on or in the same dielectric substrate. Furthermore, the patch antennas may be provided on or in the same substrate. Alternatively, one or more of the patch antennas 10 constituting the array antenna 4 may be provided on or in another member, such as a housing instead of being providing on or in the dielectric layer.

The directivity of the array antenna 4 varies depending mainly on the radiation pattern of each patch antenna 10. The patch antennas 10 have good symmetry of directivity and a high level of cross-polarization discrimination and may thus constitute a phased array antenna that offers enhanced symmetry of gain during tilt of the array antenna 4. For example, such a phased array antenna having a coverage angle of ±45° may eliminate the possibility of excessively high gain in a direction at an angle of +45° and low gain in directions at angles of −45° and 0°.

The RF signal processing circuit (RFIC) 3 includes switches 31A to 31D, 33A to 33D, and 37, power amplifiers 32AT to 32DT, low-noise amplifiers 32AR to 32DR, attenuators 34A to 34D, phase shifters 35A to 35D, a signal combiner/splitter 36, a mixer 38, and an amplifier circuit 39.

The switches 31A to 31D and 33A to 33D are switching circuits that switch between transmission and reception on corresponding signal paths.

Signals transmitted from the baseband signal processing circuit (BBIC) 2 are amplified in the amplifier circuit 39 and are then up-converted in the mixer 38. Each of the up-converted radio-frequency signals is split into four waves by the signal combiner/splitter 36. The four waves flow through the four respective transmission paths and are fed to different patch antennas 10. The phase shifters 35A to 35D disposed on the respective signal paths may provide individually adjusted degrees of phase shift, and the directivity of the array antenna 4 may be adjusted accordingly.

Radio-frequency signals received by the patch antennas 10 included in the array antenna 4 flow through four different reception paths and are combined by the signal combiner/splitter 36. The combined signals are down-converted in the mixer 38, are amplified in the amplifier circuit 39, and are then transmitted to the baseband signal processing circuit (BBIC) 2.

The RF signal processing circuit (RFIC) 3 is provided as, for example, one-chip integrated circuit component having the circuit configuration described above.

The aforementioned components, such as the switches 31A to 31D, 33A to 33D, and 37, the power amplifiers 32AT to 32DT, the low-noise amplifiers 32AR to 32DR, the attenuators 34A to 34D, the phase shifters 35A to 35D, the signal combiner/splitter 36, the mixer 38, and the amplifier circuit 39 may be optionally included in the RF signal processing circuit (RFIC) 3. The transmission paths or the reception paths may be omitted from the RF signal processing circuit (RFIC) 3. The communication device 5 according to the present embodiment is applicable to a system for transmission and reception of radio-frequency signals in a plurality of frequency bands (multi-band transmission and reception of radio-frequency signals).

[1.2 Configuration of Patch Antenna]

Figure 2:
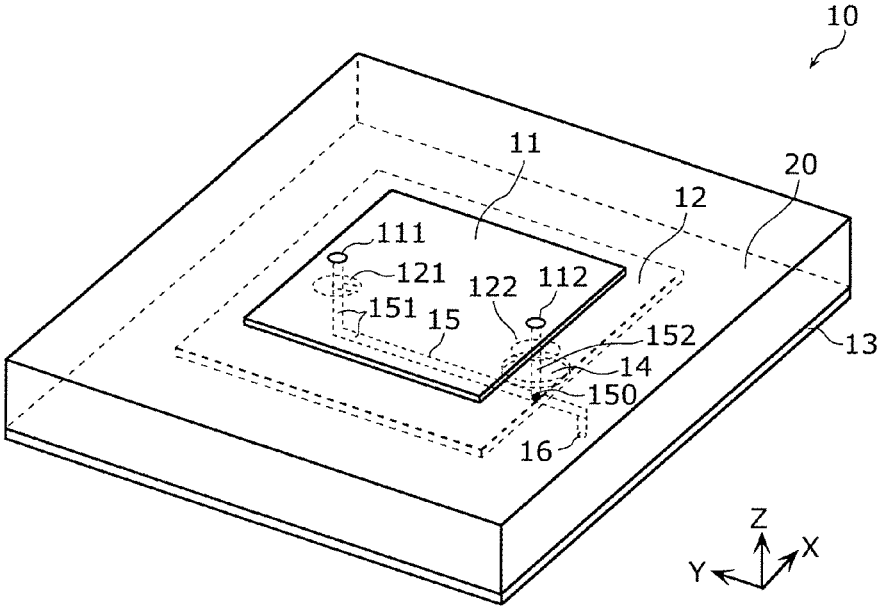
FIG. 2 is an external perspective view of a patch antenna according to Embodiment 1.
Figure 3A:
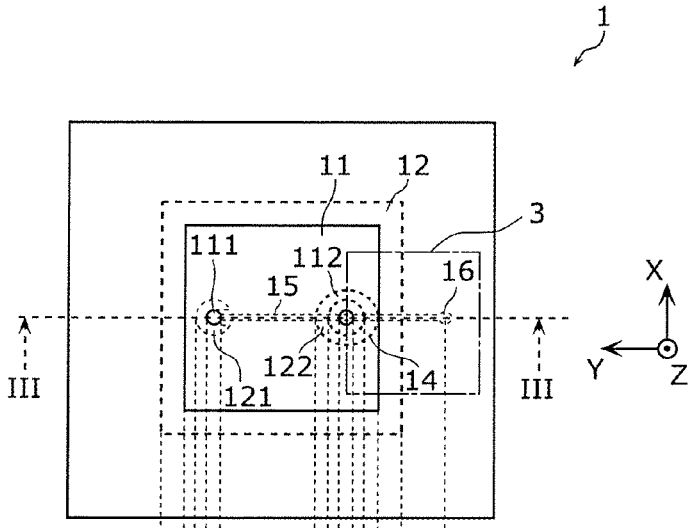
FIGS. 3A and 3B include a plan view and a sectional view, respectively, of the patch antenna according to Embodiment 1.
Figure 3B:
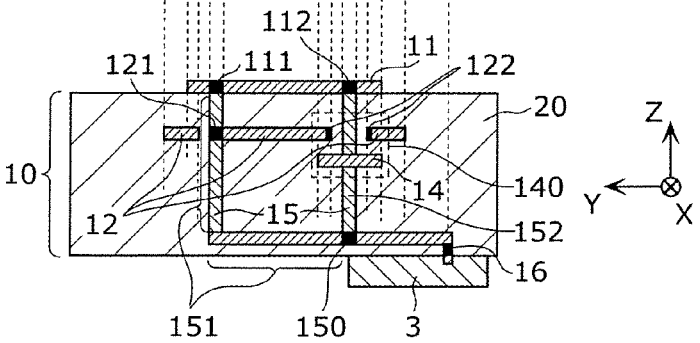
Figure 4A:
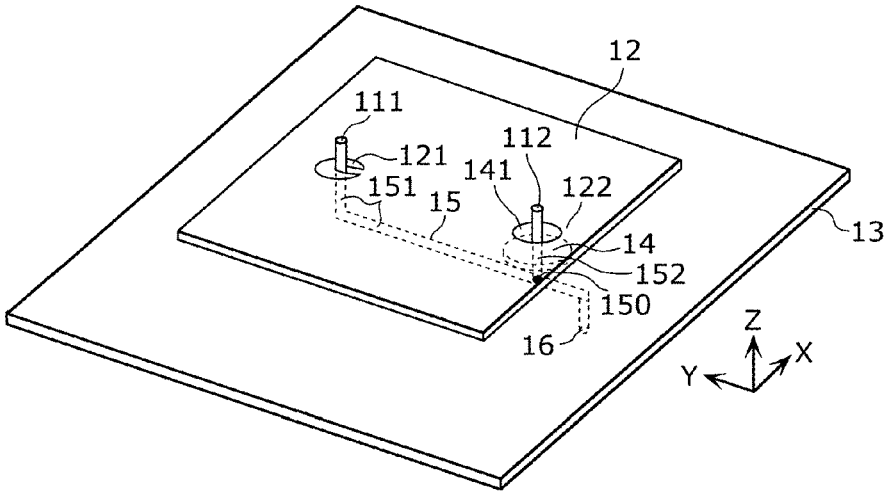
FIG. 4A is a perspective view of the patch antenna according to Embodiment 1, illustrating principal part thereof except for a first feeding conductor.
Figure 4B:
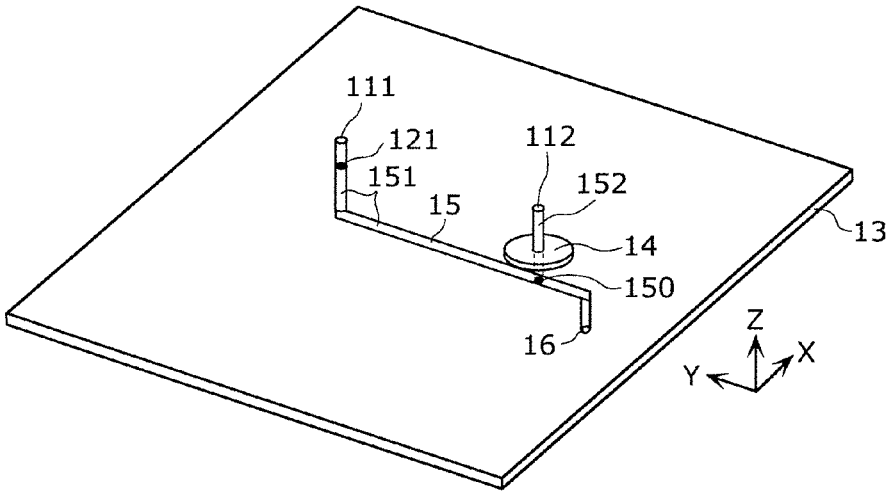
FIG. 4B is a perspective view of the patch antenna according to Embodiment 1, illustrating principal part thereof except for the first feeding conductor and a second feeding conductor.

FIG. 2 is an external perspective view of the patch antenna 10 according to Embodiment 1. FIGS. 3A and 3B include a plan view and a sectional view, respectively, of the antenna module 1 according to Embodiment 1. FIG. 4A is a perspective view of the patch antenna 10 according to Embodiment 1, illustrating principal part thereof except for a feeding conductor pattern 11 and a dielectric layer 20. FIG. 4B is a perspective view of the patch antenna 10 according to Embodiment 1, illustrating principal part thereof except for the feeding conductor pattern 11, a feeding conductor pattern 12, and the dielectric layer 20. FIG. 3B is a sectional view of the antenna module 1 taken along line III-III in FIG. 3A. A ground conductor pattern 13 is not illustrated in FIG. 3B, with emphasis on clarifying the relative arrangement of the feeding conductor patterns 11 and 12, a capacitive electrode pattern 14, and a feed line 15.

As illustrated in FIG. 2, the patch antenna 10 includes the dielectric layer 20, the ground conductor pattern 13, the feeding conductor patterns 11 and 12, and the feed line 15.

As illustrated in FIG. 3B, the antenna module 1 includes the patch antenna 10 and the RFIC 3. The RFIC 3 is a feeder circuit that feeds radio-frequency signals to the feeding conductor patterns 11 and 12. The RFIC 3 may be disposed on a main surface of the dielectric layer 20 opposite to another main surface on which the feeding conductor pattern 11 is provided.

The ground conductor pattern 13 is a ground conductor lying in a plane and provided on a main surface on the back side (in the z-axis negative direction) of the dielectric layer 20 in a manner so as to be substantially parallel to another main surface of the dielectric layer 20 as illustrated in FIG. 2. The ground conductor pattern 13 is set to ground potential.

As illustrated in FIG. 2, the feeding conductor pattern 11 is a first feeding conductor lying in a plane and disposed on the dielectric layer 20 in a manner so as to face (be substantially parallel to) the ground conductor pattern 13. The feeding conductor pattern 11 has a feed point 111 (a first feed point) and a feed point 112 (a second feed point), which are opposite to each other with respect to the center point of the feeding conductor pattern 11 when the feeding conductor pattern 11 is viewed in plan (in the direction from the Z-axis positive side to the Z-axis negative side). The feed points 111 and 112 are points on the feeding conductor pattern 11 at which the feed line 15 is in contact with the feeding conductor pattern 11. It is only required that the feed points 111 and 112 be opposite to each other with respect to the center point. To ensure radiation of radio waves with enhanced directivity, the feed points 111 and 112 can be arranged symmetrically about the center point in the Y-axis direction as illustrated in FIG. 3A.

In practical terms, the feed point is herein defined as a feed region of modest size.

As illustrated in FIG. 2, the feeding conductor pattern 12 is a second feeding conductor lying in a plane and is disposed in the dielectric layer 20 in a manner so as to face (be substantially parallel to) the ground conductor pattern 13 and the feeding conductor pattern 11 and to be on the same side as the feeding conductor pattern 11 with respect to the ground conductor pattern 13. The area of the plane of the feeding conductor pattern 12 is different from the area of the plane of the feeding conductor pattern 11. As illustrated in FIG. 4A, the feeding conductor pattern 12 has a feed point 121 (a third feed point) and a feed point 122 (a fourth feed point), which are opposite to each other with respect to the center point of the feeding conductor pattern 12 when the feeding conductor pattern 12 is viewed in plan (in the direction from the Z-axis positive side to the Z-axis negative side). The feed point 121 is a point on the feeding conductor pattern 12 at which the feed line 15 is in contact with the feeding conductor pattern 12. The feed point 122 is part of the feeding conductor pattern 12 and is a region closer than any other region of the feeding conductor pattern 12 to the feed line 15. In the present embodiment, the feed point 122 corresponds to portions of the feeding conductor pattern 12 that face each other with a cavity 141 therebetween. It is only required that the feed points 121 and 122 be opposite to each other with respect to the center point. To ensure radiation of radio waves with enhanced directivity, the feed points 121 and 122 can be arranged symmetrically about the center point in the Y-axis direction.

The center point of the feeding conductor (pattern) is herein defined as, for example, the intersection of two diagonals of the feeding conductor (pattern) when the feeding conductor (pattern) has a rectangular shape.

The feed point of the feeding conductor (pattern) is a position (point) on the feeding conductor (pattern) where the feed line extends upward from the ground conductor (pattern) side to a layer including the feeding conductor (pattern). When the feeding conductor (pattern) has a cavity through which the feed line extends with a clearance therebetween, the feed point may refer to a region that is part of the feeding conductor (pattern) and is closer than any other region of the feeding conductor (pattern) to the position mentioned above.

In the present embodiment, each of the feeding conductor patterns 11 and 12 has a rectangular shape when viewed in plan. The feed points 111 and 112 of the feeding conductor pattern 11 and the feed points 121 and 122 of the feeding conductor pattern 12 are off-center in the Y-axis direction. Thus, the main polarization direction of the patch antenna 10 coincides with the Y-axis direction, and the main polarization plane of the patch antenna 10 coincides with the Y-Z plane.

The dielectric layer 20 has a multilayer structure in which the ground conductor pattern 13 and the feeding conductor pattern 12 are disposed with a dielectric material therebetween and the feeding conductor pattern 12 and the feeding conductor pattern 11 are disposed with a dielectric material therebetween. The dielectric layer 20 may be, for example, a low-temperature co-fired ceramic (LTCC) substrate or a printed circuit board. Alternatively, the dielectric layer 20 may be merely a space in which no dielectric material is disposed. In this case, a structure that supports the feeding conductor patterns 11 and 12 is required.

The feed points 111 and 112 of the feeding conductor pattern 11 are fed directly through the feed line 15. The feed point 121 of the feeding conductor pattern 12 is fed directly through the feed line 15, and the feed point 122 of the feeding conductor pattern 12 is fed capacitively through the feed line 15.

In this configuration, radio-frequency signals lying in the first frequency band and being substantially in antiphase to each other are respectively transmitted to the feed points 111 and 112 through the feed line 15. Radio-frequency signals lying in the second frequency band different from the first frequency band and being substantially in antiphase to each other are respectively transmitted to the feed points 121 and 122 through the feed line 15.

In the configuration above, radio-frequency signals lying in the first frequency band and being substantially in antiphase to each other are respectively fed to the feed points 111 and 112, which are opposite to each other with respect to the center point of the feeding conductor pattern 11. In the flow of current from the feed points 111 and 112 through the feeding conductor pattern 11, radio-frequency currents lying in the first frequency band and respectively flowing from the feed points 111 and 112 reinforce each other. Consequently, excitation of radio-frequency signals in the first frequency band may be enhanced, and unwanted higher-order modes may be eliminated. The flow of current through the feeding conductor pattern 11 may be regulated accordingly. Thus, symmetry of the directivity of first-frequency-band radio waves radiated from the feeding conductor pattern 11 may be enhanced, and the cross-polarization discrimination (XPD) of the first-frequency-band radio waves may be improved.

Radio-frequency signals lying in the second frequency band and being substantially in antiphase to each other are respectively fed to the feed points 121 and 122 opposite to each other with respect to the center point of the feeding conductor pattern 12. In the flow of current from the feed points 121 and 122 through the feeding conductor pattern 12, radio-frequency currents lying in the second frequency band and respectively flowing from the feed points 121 and 122 reinforce each other. Consequently, excitation of radio-frequency signals in the second frequency band may be enhanced, and unwanted higher-order modes may be eliminated. The flow of current through the feeding conductor pattern 12 may be regulated accordingly. Thus, symmetry of the directivity of second-frequency-band radio waves radiated from the feeding conductor pattern 12 may be enhanced, and the cross-polarization discrimination of the second-frequency-band radio waves may be improved.

A feed line for antiphase feeding to the feeding conductor pattern 11 and a feed line for antiphase feeding to the feeding conductor pattern 12 are to be discretely located away from each other. However, it is difficult to provide the two discrete feed lines due to limitations of wiring space.

As a workaround, first-frequency-band radio waves and second-frequency-band radio waves are radiated from the patch antenna 10 in the following manner. The two feed points of the feeding conductor pattern 11, namely, the feed points 111 and 112 are fed through the feed line 15 by direct feeding. The two feed points of the feeding conductor pattern 12, namely, the feed points 121 and 122 are fed through the feed line 15 by direct feeding and capacitive feeding, respectively.

Substantially antiphase radio-frequency signals are fed to two feeding conductor patterns (the feeding conductor patterns 11 and 12) through one feed line (the feed line 15). The patch antenna 10 may thus be compact and enables radiation of radio waves in two different frequency bands while achieving good symmetry of directivity and a high level of cross-polarization discrimination.

[1.3 Specific Configurations of Feed Line and Feeding Conductors]

The following describes examples of specific configurations of the feed line 15 and the feeding conductor patterns 11 and 12 for a compact antenna element that enables radiation of radio waves while achieving good symmetry of directivity and a high level of cross-polarization discrimination as mentioned above.

As illustrated in FIG. 2 and FIG. 3B, the feed line 15 is provided in the dielectric layer 20 and includes branch lines 151 and 152 branching from a branch point 150. The feed line 15 extends from a connection node 16 on the RFIC 3 to the feed points 111 and 112. The branch line 151 extends from the branch point 150 to the feed point 111, and the branch line 152 extends from the branch point 150 to the feed point 112.

The feed point 111 is connected directly to the branch line 151, and the feed point 121 is connected directly to the branch line 151. The feed point 112 is connected directly to the branch line 152, and the feed point 122 is electrically connected to the branch line 152 through capacitive coupling. In the present embodiment, a capacitive coupling portion 140 is provided between the feed point 122 and the branch line 152 as illustrated in FIG. 3B. Radio-frequency signals in the second frequency band flow through the capacitive coupling portion 140.

The branch lines 151 and 152 are of different lengths. Specifically, a line length difference L denoting the difference between the length of the branch line 151 and the length of the branch line 152 can be written as $L \approx (n+1/2)\lambda 1g$, where n is any integer and $\lambda 1g$ is the wavelength (in the dielectric layer 20) at the center frequency of the first frequency band.

The branch line 151 may thus be used to feed the feed point 111 of the feeding conductor pattern 11 and to feed the feed point 121 of the feeding conductor pattern 12. Similarly, the branch line 152 may thus be used to feed the feed point 112 of the feeding conductor pattern 11 and to feed the feed point 122 of the feeding conductor pattern 12. Owing to the line length difference L, which is the difference between the length of the branch line 151 and the length of the branch line 152, radio-frequency signals lying in the first frequency band and being substantially in antiphase to each other may be respectively fed to the feed points 111 and 112 of the feeding conductor pattern 11.

Meanwhile, it is difficult to feed substantially antiphase radio-frequency signals in the second frequency band to the respective feed points 121 and 122 of the feeding conductor pattern 12 by direct feeding feasible with the aid of the line length difference L. As a workaround, the feed point 122 is connected to the branch line 152 through the capacitive coupling portion 140. The capacitance of the capacitive coupling portion 140 may be optimized so that radio-frequency signals lying in the second frequency band and being substantially in antiphase to each other are respectively fed to the feed points 121 and 122 of the feeding conductor pattern 12.

Owing to the line length difference L, which is the difference between the length of the branch line 151 and the length of the branch line 152, the phase difference between radio-frequency signals lying in the first frequency band and respectively directed to the feed points 111 and 112 of the feeding conductor pattern 11 may be set so that these radio-frequency signals are substantially in antiphase to each other. Owing to the line length difference L and the capacitive value of the capacitive coupling portion 140, the phase difference between radio-frequency signals lying in the second frequency band and respectively directed to the feed points 121 and 122 of the feeding conductor pattern 12 may be set so that these radio-frequency signals are substantially in antiphase to each other.

Owing to this configuration, radio-frequency signals directed to the feed points 111, 112, 121, and 122 may be transmitted through two branch lines, namely, the branch lines 151 and 152, and the phase difference between radio-frequency signals lying in the first frequency band and respectively directed to the feed points 111 and 112 of the feeding conductor pattern 11 and the phase difference between radio-frequency signals lying in the second frequency band and respectively directed to the feed points 121 and 122 of the feeding conductor pattern 12 may be individually set. The patch antenna 10 and the antenna module 1 may thus be compact and enable radiation of radio waves in two different frequency bands while achieving good symmetry of directivity and a high level of cross-polarization discrimination.

In the present embodiment, the ground conductor pattern 13, the feeding conductor pattern 12, and the feeding conductor pattern 11 are disposed in the stated order (in the direction from the Z-axis negative side to the Z-axis positive side). The feeding conductor pattern 12 has the cavity 141 at the feed point 122, where the feed line 15 extends through the cavity 141 with a clearance therebetween.

Capacitive coupling may thus be provided between the feed point 122 and the feed line 15.

The following describes the configuration of the capacitive coupling portion 140.

As illustrated in FIGS. 3B, 4A, and 4B, the capacitive coupling portion 140 includes the cavity 141, the capacitive electrode pattern 14, and the feeding conductor pattern 12. The cavity 141 is provided in a plane in which the feeding conductor pattern 12 lies. The feeding conductor pattern 12 is not provided in the cavity 141. The branch line 152 extends through the cavity 141. The capacitive electrode pattern 14 is an electrode pattern lying in a plane and is disposed between the feeding conductor pattern 12 and the ground conductor pattern 13 in a manner so as to cover the cavity 141 when the feeding conductor pattern 12 is viewed in plan. The capacitive electrode pattern 14 is connected directly to the feed line 15. In this state, the feed line 15 extends through the capacitive electrode pattern 14.

The capacitive coupling portion 140 configured as described above provides parallel plate capacitance where part of the dielectric layer 20 is sandwiched between the capacitive electrode pattern 14 and a region being part of the feeding conductor pattern 12 and extending along the periphery of the cavity 141.

Thus, capacitive coupling may be provided between the feed point 122 and the branch line 152 without necessarily impairing the compactness of (or the area savings achieved by) the patch antenna 10.

In the present embodiment, the first frequency band is in a frequency range higher than the second frequency band. The electrical length in a direction of connection between the feed points 111 and 112 of the feeding conductor pattern 11 is shorter than the electrical length in a direction of connection between the feed points 121 and 122 of the feeding conductor pattern 12.

The line length difference L, which is the difference between the length of the branch line 151 and the length of the branch line 152, helps achieve the antiphase state of radio-frequency signals in the first frequency band in the higher frequency range. Together with the line length difference L, the capacitive coupling portion 140 helps achieve the antiphase state of radio-frequency signals in the second frequency band in the lower frequency range.

In the present embodiment, the ground conductor pattern 13, the feeding conductor pattern 12, and the feeding conductor pattern 11 are disposed in the stated order (in the direction from the Z-axis negative side to the Z-axis positive side). Consequently, the feeding conductor pattern 11 configured to radiate radio-frequency signals in the first frequency band in the higher frequency range is smaller than the feeding conductor pattern 12 configured to radiate radio-frequency signals in the second frequency band in the lower frequency range, and the feeding conductor pattern 11 is father than the feeding conductor pattern 12 from the ground conductor pattern 13. This configuration eliminates or reduces the possibility that the feeding conductor pattern 11 will interfere with radio-frequency signals lying in the second frequency band and radiated from the feeding conductor pattern 12 in a direction opposite to the ground conductor pattern 13.

In some embodiments of the patch antenna according to the present disclosure, the first frequency band may be in a frequency range lower than the second frequency band, and the electrical length in the direction of connection between the feed points 111 and 112 of the feeding conductor pattern 11 may be longer than the electrical length in the direction of connection between the feed points 121 and 122 of the feeding conductor pattern 12.

The line length difference L, which is the difference between the length of the branch line 151 and the length of the branch line 152, helps achieve the antiphase state of radio-frequency signals in the first frequency band in the lower frequency range. Together with the line length difference L, the capacitive coupling portion 140 helps achieve the antiphase state of radio-frequency signals in the second frequency band in the higher frequency range.

Figures 5A, 5B, 5C:
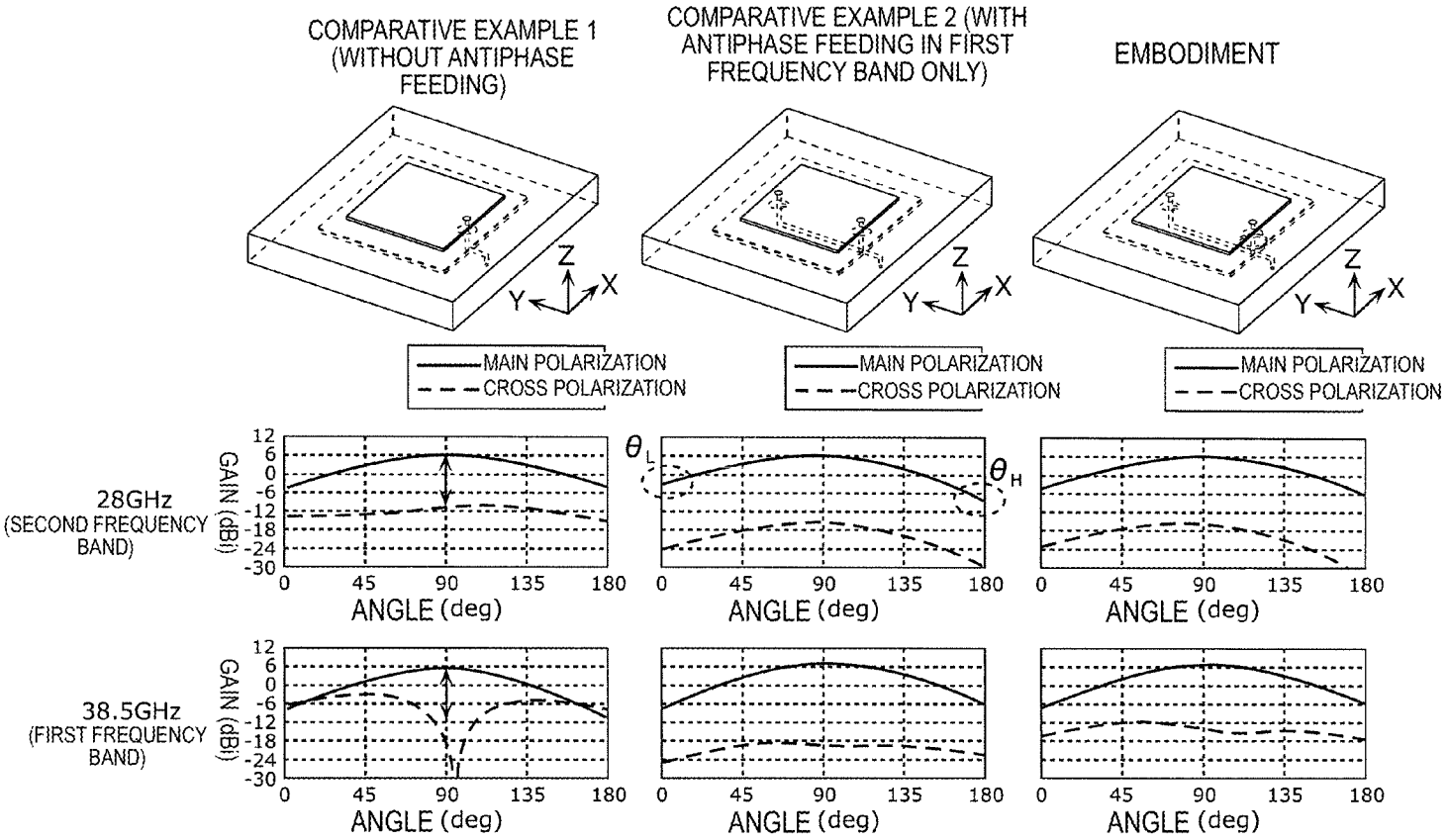
FIGS. 5A, 5B, and 5C include graphs illustrating radiation characteristics associated with patch antennas according to Embodiment 1, Comparative Example 1, and Comparative Example 2, respectively.

FIGS. 5A, 5B, and 5C include graphs illustrating radiation characteristics associated with patch antennas according to Embodiment 1, Comparative Example 1, and Comparative Example 2, respectively. More specifically, the upper sections of FIGS. 5A, 5B, and 5C illustrate configurations of the patch antennas according to Embodiment 1 (FIG. 5C), Comparative Example 1 (FIG. 5A), and Comparative Example 2 (FIG. 5B), respectively. The middle sections of FIGS. 5A, 5B, and 5C illustrate the radiation intensity (gain) distributions of main polarization (in the Y-Z plane passing through feed points) and cross polarization (in the X-Z plane passing through feed points) of radio-frequency signals lying in the second frequency band (28.0 GHz) and radiated from the feeding conductor pattern 12. The lower sections of FIGS. 5A, 5B, and 5C illustrate the radiation intensity (gain) distributions of main polarization (in the Y-Z plane passing through the feed points) and cross polarization (in the X-Z plane passing through the feed points) of radio-frequency signals lying in the first frequency band (38.5 GHz) and radiated from the feeding conductor pattern 11.

The patch antenna according to Comparative Example 1 differs from the patch antenna 10 according to Embodiment 1 in that each feeding conductor has only one feed point. That is, the patch antenna according to Comparative Example 1 does not involve antiphase feeding to the feeding conductors.

As with each feeding conductor of the patch antenna 10 according to Embodiment 1, each feeding conductor of the patch antenna according to Comparative Example 2 has two feed points. The patch antenna according to Comparative Example 2 involves antiphase feeding to the feeding conductor pattern 11 only; that is, the patch antenna does not involve antiphase feeding to the feeding conductor pattern 12.

In each of Embodiment 1, Comparative Example 1, and Comparative Example 2, the radiation intensity distribution of main polarization has directivity in a direction from the feeding conductor pattern 11 to the zenith, that is, in the Z-axis positive direction (at an angle of 90° in FIGS. 5A, 5B, and 5C) as illustrated in the middle sections of FIGS. 5A, 5B, and 5C.

As to the patch antenna according to Comparative Example 1, the difference between the radiation intensity of main polarization and the radiation intensity of cross polarization is small in the first frequency band (38.5 GHz) and in the second frequency band (28.0 GHz) as illustrated in FIG. 5A, and as a result, the level of cross-polarization discrimination is low. In first frequency band (38.5 GHz) in particular, the level of cross-polarization discrimination is extremely low at angles close to the horizontal direction (at angles of 0 to 45° and angles of 135° to 180°).

As to the patch antenna according to Comparative Example 2, the radiation intensity of main polarization in the second frequency band (28.0 GHz) without necessarily antiphase feeding is out of balance across the angles concerned, as illustrated in FIG. 5B. Specifically, referring to the middle section of FIG. 5B, the difference between the radiation intensity of main polarization at an angle of about 0° (in a region $\theta_L$ in FIG. 5B) and the radiation intensity of main polarization at an angle of about 180° (in a region $\theta_H$ in FIG. 5B) is large. This means that symmetry of the directivity associated with the radiation intensity of radio-frequency signals in the second frequency band (28.0 GHz) is impaired.

Meanwhile, as illustrated in FIG. 5C, the patch antenna 10 according to the present embodiment advantageously involves antiphase feeding to the feeding conductor patterns 11 and 12 through the feed line 15, and a high level of cross-polarization discrimination and good symmetry of directivity are thus achieved in the first frequency band (38.5 GHz) and in the second frequency band (28.0 GHz). Thus, the patch antenna 10 may thus be compact and enables radiation of radio waves in two different frequency bands while achieving good symmetry of directivity and a high level of cross-polarization discrimination.

The ground conductor pattern 13, the feeding conductor pattern 11, and the feeding conductor pattern 12 of the patch antenna according to the present embodiment may be disposed in the stated order. In this case, the feed points 111 and 112 of the feeding conductor pattern 11 are fed directly through the feed line 15, the feed point 121 of the feeding conductor pattern 12 is fed directly through the feed line 15, and the feed point 122 of the feeding conductor pattern 12 is fed capacitively fed through the feed line 15. The patch antenna concerned may thus be compact and enables radiation of radio waves in two different frequency bands while achieving good symmetry of directivity and a high level of cross-polarization discrimination.

With the ground conductor pattern 13, the feeding conductor pattern 11, and the feeding conductor pattern 12 being disposed in the stated order, the feed points 121 and 122 of the feeding conductor pattern 12 may be fed directly through the feed line 15, the feed point 111 of the feeding conductor pattern 11 may be fed directly through the feed line 15, and the feed point 112 of the feeding conductor pattern 11 may be fed capacitively through the feed line 15. The patch antenna concerned may thus be compact and enables radiation of radio waves in two different frequency bands while achieving good symmetry of directivity and a high level of cross-polarization discrimination.

With the ground conductor pattern 13, the feeding conductor pattern 11, and the feeding conductor pattern 12 being disposed in the stated order, the first frequency band specified for the feeding conductor pattern 11 may be in a frequency range lower than the second frequency band specified for the feeding conductor pattern 12, and the electrical length in the direction of connection between the feed points 111 and 112 of the feeding conductor pattern 11 may be longer than the electrical length in the direction of connection between the feed points 121 and 122 of the feeding conductor pattern 12. This configuration eliminates or reduces the possibility that the feeding conductor pattern 12 will interfere with radio-frequency signals lying in the first frequency band and radiated from the feeding conductor pattern 11 in a direction opposite to the ground conductor pattern 13.

Embodiment 2

The patch antenna 10 according to Embodiment 1 is compact and achieves good symmetry of directivity and a high level of cross-polarization discrimination by adopting the configuration in which the two feed points of the feeding conductor pattern 11 are fed by direct feeding, and two feed points of the feeding conductor pattern 12 are fed by direct feeding and capacitive feeding, respectively. The difference between Embodiment 1 and the present embodiment is in the configuration of the capacitive coupling portion for capacitive feeding to the feed points of the feeding conductor pattern 12.

[2.1 Configuration of Patch Antenna]

Figure 6:
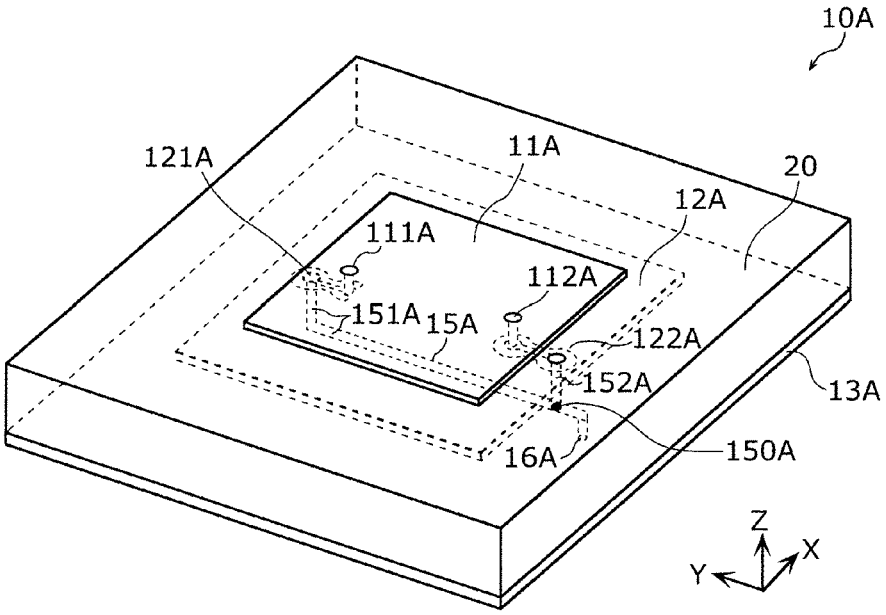
FIG. 6 is an external perspective view of a patch antenna according to Embodiment 2.
Figure 7A:
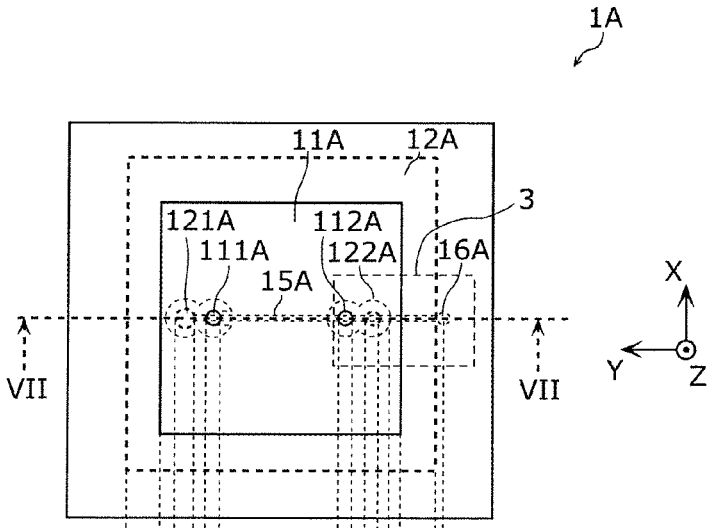
FIGS. 7A and 7B include a plan view and a sectional view, respectively, of the patch antenna according to Embodiment 2.
Figure 7B:
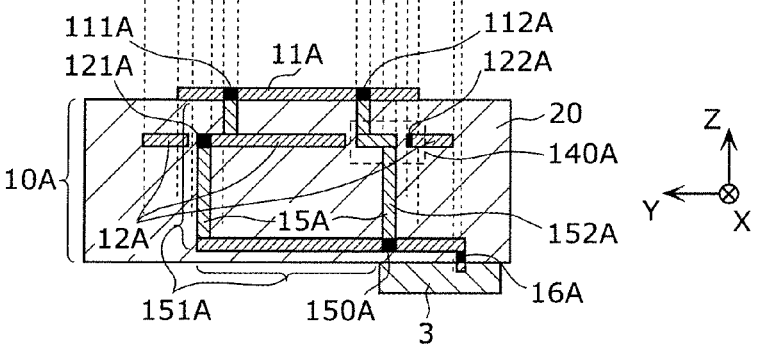
Figure 8A:
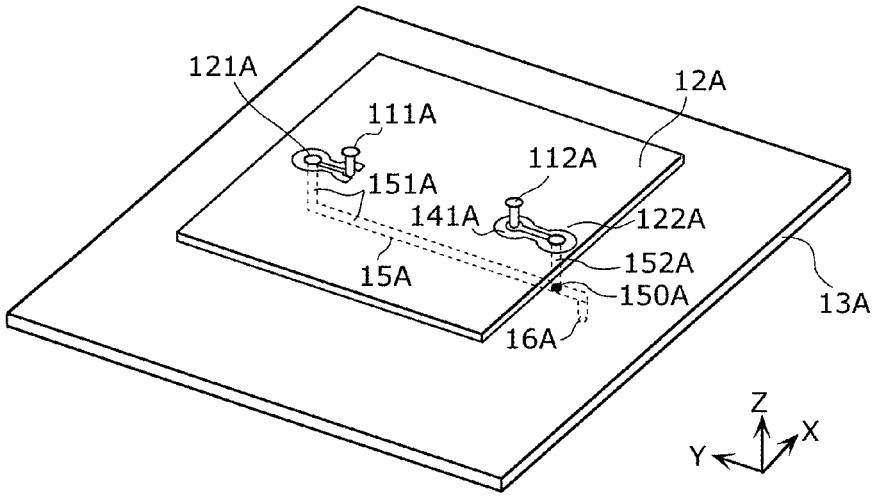
FIG. 8A is a perspective view of the patch antenna according to Embodiment 2, illustrating principal part thereof except for a first feeding conductor.
Figure 8B:
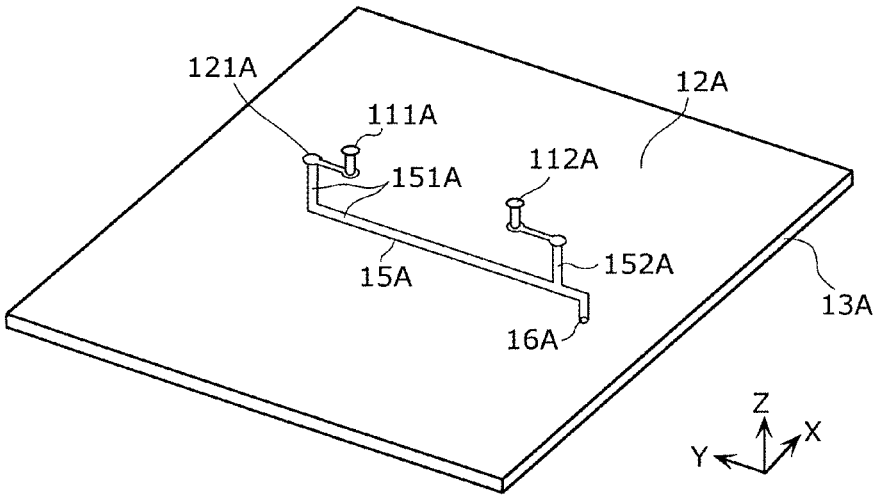
FIG. 8B is a perspective view of the patch antenna according to Embodiment 2, illustrating principal part thereof except for the first feeding conductor and a second feeding conductor.

FIG. 6 is an external perspective view of a patch antenna 10A according to Embodiment 2. FIGS. 7A and 7B include a plan view and a sectional view, respectively, of an antenna module 1A according to Embodiment 2. FIG. 8A is a perspective view of the patch antenna 10A according to Embodiment 2, illustrating principal part thereof except for a feeding conductor pattern 11A and the dielectric layer 20. FIG. 8B is a perspective view of the patch antenna 10A according to Embodiment 2, illustrating principal part thereof except for the feeding conductor pattern 11A, a feeding conductor pattern 12A, and the dielectric layer 20. FIG. 7B is a sectional view of the antenna module 1A taken along line VII-VII in FIG. 7A.

As illustrated in FIG. 6, the patch antenna 10A includes the dielectric layer 20, a ground conductor pattern 13A, the feeding conductor patterns 11A and 12A, and a feed line 15A. As illustrated in FIG. 7B, the antenna module 1A includes the patch antenna 10A and the RFIC 3. The patch antenna 10A and the antenna module 1A according to the present embodiment respectively differ from the patch antenna 10 and the antenna module 1 according to Embodiment 1 mainly in that a capacitive coupling portion 140A has a distinctive configuration. Configurations common to the patch antenna 10A according to the present embodiment and the patch antenna 10 according to Embodiment 1 and configurations common to the antenna module 1A according to the present embodiment and the antenna module 1 according to Embodiment 1 will be omitted from the following description, which will be given while focusing on distinctive configurations in the present embodiment.

The ground conductor pattern 13A has a configuration identical to the configuration of the ground conductor pattern 13 in Embodiment 1.

As illustrated in FIG. 6, the feeding conductor pattern 11A is a first feeding conductor lying in a plane and is disposed on the dielectric layer 20 in a manner so as to face (be substantially parallel to) the ground conductor pattern 13A. The feeding conductor pattern 11A has a feed point 111A (a first feed point) and a feed point 112A (a second feed point), which are opposite to each other with respect to the center point of the feeding conductor pattern 11A when the feeding conductor pattern 11A is viewed in plan (in the direction from the Z-axis positive side to the Z-axis negative side). The feed points 111A and 112A are points on the feeding conductor pattern 11A at which the feed line 15A is in contact with the feeding conductor pattern 11A.

As illustrated in FIG. 6, the feeding conductor pattern 12A is a second feeding conductor lying in a plane and is disposed in the dielectric layer 20 in a manner so as to face (be substantially parallel to) the ground conductor pattern 13A and the feeding conductor pattern 11A and to be on the same side as the feeding conductor pattern 11A with respect to the ground conductor pattern 13A. The area of the plane of the feeding conductor pattern 12A is different from the area of the plane of the feeding conductor pattern 11A. As illustrated in FIG. 8A, the feeding conductor pattern 12A has a feed point 121A (a third feed point) and a feed point 122A (a fourth feed point), which are opposite to each other with respect to the center point of the feeding conductor pattern 12A when the feeding conductor pattern 12A is viewed in plan (in the direction from the Z-axis positive side to the Z-axis negative side). The feed point 121A is a point on the feeding conductor pattern 12A at which the feed line 15A is in contact with the feeding conductor pattern 12A. The feed point 122A is part of the feeding conductor pattern 12A and is a region closer than any other region of the feeding conductor pattern 12A to the feed line 15A.

The feed points 111A and 112A of the feeding conductor pattern 11A are fed directly through the feed line 15A. The feed point 121A of the feeding conductor pattern 12A is fed directly through the feed line 15A, and the feed point 122A of the feeding conductor pattern 12A is fed capacitively through the feed line 15A.

In this configuration, radio-frequency signals lying in the first frequency band and being substantially in antiphase to each other are respectively transmitted to the feed points 111A and 112A through the feed line 15A. Radio-frequency signals lying in the second frequency band different from the first frequency band and being substantially in antiphase to each other are respectively transmitted to the feed points 121A and 122A through the feed line 15A.

Owing to this configuration, symmetry of the directivity of first-frequency-band radio waves radiated from the feeding conductor pattern 11A may be enhanced, and the cross-polarization discrimination of the first-frequency-band radio waves may be improved. Similarly, symmetry of the directivity of second-frequency-band radio waves radiated from the feeding conductor pattern 12A may be enhanced, and the cross-polarization discrimination of the second-frequency-band radio waves may be improved.

First-frequency-band radio waves and second-frequency-band radio waves are radiated from the patch antenna 10A in such a manner that the feed points 111A and 112A of the feeding conductor pattern 11A are fed through the feed line 15A by direct feeding. The feed points 121A and 122A of the feeding conductor pattern 12A are fed through the feed line 15A by direct feeding and capacitive feeding, respectively.

Substantially antiphase radio-frequency signals are fed to two feeding conductor patterns (the feeding conductor patterns 11A and 12A) through one feed line (the feed line 15A). The patch antenna 10A may thus be compact and enables radiation of radio waves in two different frequency bands while achieving good symmetry of directivity and a high level of cross-polarization discrimination.

[2.2 Specific Configurations of Feed Line and Feeding Conductors]

The following describes examples of specific configurations of the feed line 15A and the feeding conductor patterns 11A and 12A for a compact antenna element that enables radiation of radio waves while achieving good symmetry of directivity and a high level of cross-polarization discrimination as mentioned above.

As illustrated in FIG. 6 and FIG. 7B, the feed line 15A is provided in the dielectric layer 20 and includes branch lines 151A and 152A branching from a branch point 150A. The feed line 15A extends from a connection node 16A on the RFIC 3 to the feed points 111A and 112A. The branch line 151A extends from the branch point 150A to the feed point 111A, and the branch line 152A extends from the branch point 150A to the feed point 112A.

The feed point 111A is connected directly to the branch line 151A, and the feed point 121A is connected directly to the branch line 151A. The feed point 112A is connected directly to the branch line 152A, and the feed point 122A is electrically connected to the branch line 152A through capacitive coupling. Specifically, the capacitive coupling portion 140A is provided between the feed point 122A and the branch line 152A as illustrated in FIG. 7B. Radio-frequency signals in the second frequency band flow through the capacitive coupling portion 140A.

The branch lines 151A and 152A are of different lengths. Specifically, a line length difference L denoting the difference between the length of the branch line 151A and the length of the branch line 152A can be written as $L \approx (n+1/2)\lambda 1g$, where n is any integer and $\lambda 1g$ is the wavelength (in the dielectric layer 20) at the center frequency of the first frequency band.

Owing to this configuration, radio-frequency signals directed to the feed points 111A, 112A, 121A, and 122A may be transmitted through two branch lines, namely, the branch lines 151A and 152A, and the phase difference between radio-frequency signals lying in the first frequency band and respectively directed to the feed points 111A and 112A of the feeding conductor pattern 11A and the phase difference between radio-frequency signals lying in the second frequency band and respectively directed to the feed points 121A and 122A of the feeding conductor pattern 12A may be individually set. Thus, the patch antenna 10A and the antenna module 1A may thus be compact and enable radiation of radio waves in two different frequency bands while achieving good symmetry of directivity and a high level of cross-polarization discrimination.

In the present embodiment, the ground conductor pattern 13A, the feeding conductor pattern 12A, and the feeding conductor pattern 11A are disposed in the stated order (in the direction from the Z-axis negative side to the Z-axis positive side). The feeding conductor pattern 12A has a cavity 141A at the feed point 122A, where the feed line 15A extends through the cavity 141A with a clearance therebetween.

Capacitive coupling may thus be provided between the feed point 122A and the feed line 15A.

The following describes the configuration of the capacitive coupling portion 140A.

As illustrated in FIGS. 7B, 8A, and 8B, the capacitive coupling portion 140A has the cavity 141A. The cavity 141A is provided in a plane in which the feeding conductor pattern 12A lies. The feeding conductor pattern 12A is not provided in the cavity 141A. The feed points 112A and 122A are discretely located away from each other when the feeding conductor patterns 11A and 12A are viewed in plan. In the cavity 141A, part of the feed line 15A is disposed along a plane in which the feeding conductor pattern 12A extends.

Part of the branch line 152A disposed along the plane in which the feeding conductor pattern 12A extends and part of the feeding conductor pattern 12A surrounding the part of the branch line 152A with the cavity 141A therebetween thus provide capacitance in the direction in which the plane extends. Thus, capacitive coupling may be provided between the feed point 122A and the branch line 152A without necessarily impairing the compactness of (or the height reduction achieved by) the patch antenna 10A.

Embodiment 3

The patch antennas that radiates, from each feeding conductor, waves linearly polarized in one direction have been described so far in Embodiments 1 and 2. In the present embodiment, meanwhile, a patch antenna that radiates, from each feeding conductor, waves linearly polarized in two directions orthogonal to each other will be described.

[3.1 Configuration of Patch Antenna]

Figure 9:
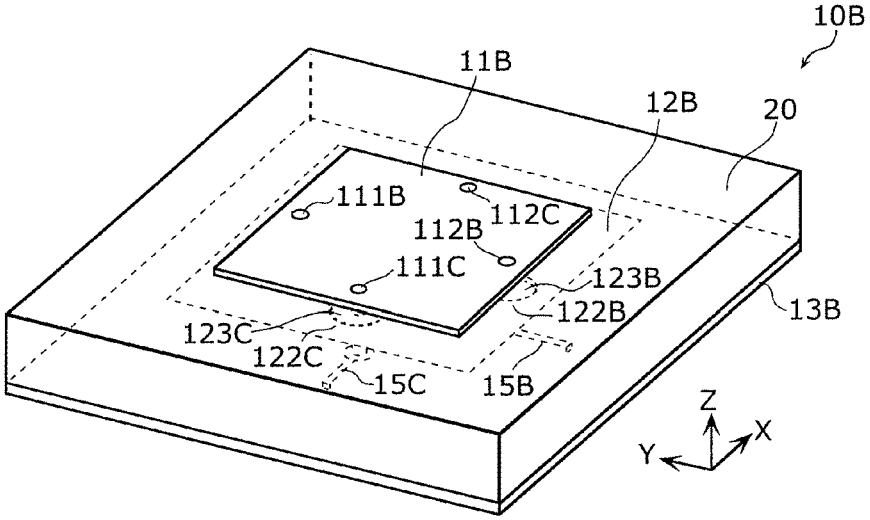
FIG. 9 is an external perspective view of a patch antenna according to Embodiment 3.
Figure 10A:
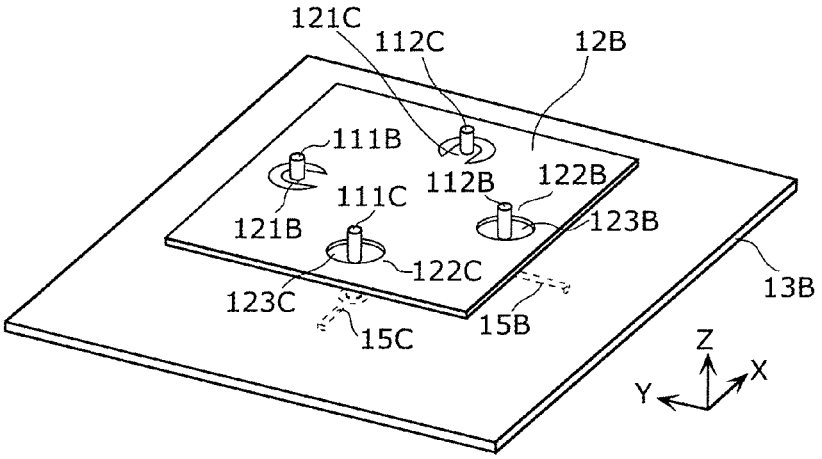
FIG. 10A is a perspective view of the patch antenna according to Embodiment 3, illustrating principal part thereof except for a first feeding conductor.
Figure 10B:
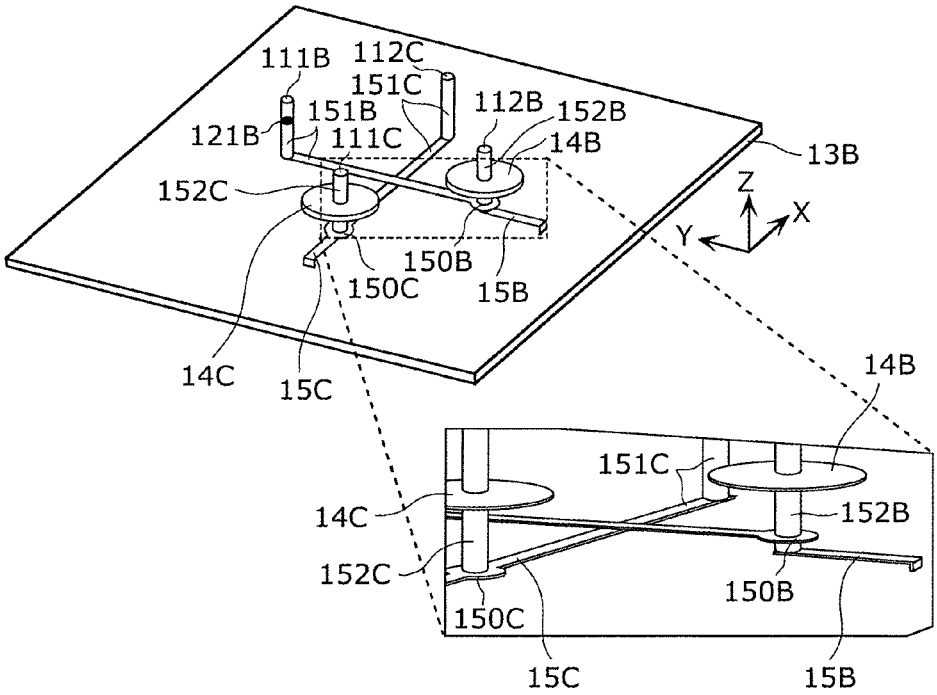
FIG. 10B is a perspective view of the patch antenna according to Embodiment 3, illustrating principal part thereof except for the first feeding conductor and a second feeding conductor.

FIG. 9 is an external perspective view of a patch antenna 10B according to Embodiment 3. FIG. 10A is a perspective view of the patch antenna 10B according to Embodiment 3, illustrating principal part thereof except for a feeding conductor pattern 11B and the dielectric layer 20. FIG. 10B is a perspective view of the patch antenna 10B according to Embodiment 3, illustrating principal part thereof except for the feeding conductor pattern 11B, a feeding conductor pattern 12B, and the dielectric layer 20.

As illustrated in FIG. 9, the patch antenna 10B includes the dielectric layer 20, a ground conductor pattern 13B, the feeding conductor patterns 11B and 12B, and feed lines 15B and 15C. The patch antenna 10B according to the present embodiment differs from the patch antenna 10 according to Embodiment 1 in that each feeding conductor has two pairs of feed points for substantially antiphase feeding of radio-frequency signals and that the feed lines for transmission of radio-frequency signals to the respective pairs of feed points have distinctive configurations. Configurations common to the patch antenna 10B according to the present embodiment and the patch antenna 10 according to Embodiment 1 will be omitted from the following description, which will be given while focusing on distinctive configurations in the present embodiment.

As illustrated in FIG. 9, the feeding conductor pattern 11B is a first feeding conductor lying in a plane and is disposed on the dielectric layer 20 in a manner so as to face (be substantially parallel to) the ground conductor pattern 13B. The feeding conductor pattern 11B has a feed point 111B (a first feed point) and a feed point 112B (a second feed point), which are opposite to each other with respect to the center point of the feeding conductor pattern 11B when the feeding conductor pattern 11B is viewed in plan (in the direction from the Z-axis positive side to the Z-axis negative side). The feed points 111B and 112B are points on the feeding conductor pattern 11B at which the feed line 15B intersects the feeding conductor pattern 11B. The feeding conductor pattern 11B also has a feed point 111C (a fifth feed point) and a feed point 112C (a sixth feed point), which are opposite to each other with respect to the center point of the feeding conductor pattern 11B when the feeding conductor pattern 11B is viewed in plan. The feed points 111C and 112C are points on the feeding conductor pattern 11B at which the feed line 15C intersects the feeding conductor pattern 11B. When the feeding conductor pattern 11B is viewed in plan, an imaginary line connecting the feed point 111C to the feed point 112C is orthogonal to an imaginary line connecting the feed point 111B to the feed point 112B.

As illustrated in FIG. 10A, the feeding conductor pattern 12B is a second feeding conductor lying in a plane and is disposed in the dielectric layer 20 in a manner so as to face (be substantially parallel to) the ground conductor pattern 13B and the feeding conductor pattern 11B. The feeding conductor pattern 12B has a feed point 121B (a third feed point) and a feed point 122B (a fourth feed point), which are opposite to each other with respect to the center point of the feeding conductor pattern 12B when the feeding conductor pattern 12B is viewed in plan (in the direction from the Z-axis positive side to the Z-axis negative side). The feed point 121B is a point on the feeding conductor pattern 12B at which the feed line 15B intersects the feeding conductor pattern 12B. The feed point 122B is part of the feeding conductor pattern 12B and is a region that is closer than any other region of the feeding conductor pattern 12B to the feed line 15B. The feeding conductor pattern 12B also has a feed point 121C (a seventh feed point) and a feed point 122C (an eighth feed point), which are opposite to each other with respect to the center point of the feeding conductor pattern 12B when the feeding conductor pattern 12B is viewed in plan. The feed point 121C is a point on the feeding conductor pattern 12B at which the feed line 15C intersects the feeding conductor pattern 12B. The feed point 122C is part of the feeding conductor pattern 12B and is a region closer than any other region of the feeding conductor pattern 12B to the feed line 15C. When the feeding conductor pattern 12B is viewed in plan, an imaginary line connecting the feed point 121C to the feed point 122C is orthogonal to an imaginary line connecting the feed point 121B to the feed point 122B.

In the present embodiment, each of the feeding conductor patterns 11B and 12B has a rectangular shape.

The feed points 111B and 112B of the feeding conductor pattern 11B and the feed points 121B and 122B of the feeding conductor pattern 12B are off-center in the Y-axis direction. Thus, a first polarization direction of the feeding conductor patterns 11B and 12B coincides with the Y-axis direction, and the polarization plane of the feeding conductor patterns 11B and 12B coincides with the Y-Z plane.

The feed points 111C and 112C of the feeding conductor pattern 11B and the feed points 121C and 122C of the feeding conductor pattern 12B are off-center in the X-axis direction. Thus, a second polarization direction of the feeding conductor patterns 11B and 12B coincides with the X-axis direction, and the polarization plane of the feeding conductor patterns 11B and 12B coincides with the X-Z plane.

The feed points 111B and 112B of the feeding conductor pattern 11B are fed directly through the feed line 15B (the first feed line). The feed point 121B of the feeding conductor pattern 12B is fed directly through the feed line 15B (a first feed line), and the feed point 122B of the feeding conductor pattern 12B is fed capacitively through the feed line 15B (the first feed line).

The feed points 111C and 112C of the feeding conductor pattern 11B are fed directly through the feed line 15C (a second feed line). The feed point 121C of the feeding conductor pattern 12B is fed directly through the feed line 15C (the second feed line), and the feed point 122C of the feeding conductor pattern 12B is fed capacitively through the feed line 15C (the second feed line).

This configuration offers the following advantages. Owing to the feeding through the feed line 15B, first-frequency-band radio waves having the first polarization direction are radiated from the feeding conductor pattern 11B, and second-frequency-band radio waves having the first polarization direction are radiated from the feeding conductor pattern 12B. Owing to the feeding through the feed line 15C, first-frequency-band radio waves having the second polarization direction orthogonal to the first polarization direction are radiated from the feeding conductor pattern 11B, and second-frequency-band radio waves having the second polarization direction are radiated from the feeding conductor pattern 12B. That is, first-frequency-band radio waves polarized in two directions orthogonal to each other may be radiated from the feeding conductor pattern 11B, and second-frequency-band radio waves polarized in two directions orthogonal to each other may be radiated from the feeding conductor pattern 12B.

The following describes specific configurations of the feed lines 15B and 15C.

As illustrated in FIG. 10B, the feed line 15B is provided in the dielectric layer 20 and includes branch lines 151B and 152B branching from a branch point 150B. The feed line 15B extends from a connection node on the RFIC 3 to the feed points 111B and 112B. The branch line 151B extends from the branch point 150B to the feed point 111B, and the branch line 152B extends from the branch point 150B to the feed point 112B.

The feed point 111B is connected directly to the branch line 151B, and the feed point 121B is connected directly to the branch line 151B. The feed point 112B is connected directly to the branch line 152B, and the feed point 122B is electrically connected to the branch line 152B through capacitive coupling. Specifically, a capacitive coupling portion is provided between the feed point 122B and the branch line 152B. Radio-frequency signals in the second frequency band flow through the capacitive coupling portion.

The branch lines 151B and 152B are of different lengths. Specifically, a line length difference $L_B$ denoting the difference between the length of the branch line 151B and the length of the branch line 152B can be written as $L_B \approx (n+1/2)\lambda_B g$, where n is any integer and $\lambda_B g$ is the wavelength (in the dielectric layer 20) at the center frequency of the first frequency band.

The branch line 151B may thus be used to feed the feed point 111B of the feeding conductor pattern 11B and to feed the feed point 121 of the feeding conductor pattern 12B. Similarly, the branch line 152B may thus be used to feed the feed point 112B of the feeding conductor pattern 11B and to feed the feed point 122B of the feeding conductor pattern 12B. Owing to the line length difference $L_B$, which is the difference between the length of the branch line 151B and the length of the branch line 152B, radio-frequency signals lying in the first frequency band and being substantially in antiphase to each other may be respectively fed to the feed points 111B and 112B of the feeding conductor pattern 11B.

Meanwhile, it is difficult to feed substantially antiphase radio-frequency signals in the second frequency band to the feed points 121B and 122B of the feeding conductor pattern 12B by direct feeding feasible with the aid of the line length difference $L_B$. As a workaround, the feed point 122B is connected to the branch line 152B through the capacitive coupling portion. The capacitance of the capacitive coupling portion may be optimized so that radio-frequency signals lying in the second frequency band and being substantially in antiphase to each other are respectively fed to the feed points 121B and 122B of the feeding conductor pattern 12B.

As illustrated in FIGS. 10A and 10B, the capacitive coupling portion for the feed point 122B includes a cavity 123B, a capacitive electrode pattern 14B, and the feeding conductor pattern 12B. The cavity 123B is a first cavity provided in a plane in which the feeding conductor pattern 12B lies. The feeding conductor pattern 12B is not provided in the cavity 123B. The branch line 152B extends through the cavity 123B. The capacitive electrode pattern 14B is an electrode pattern lying in a plane and is disposed in a manner so as to face the feeding conductor pattern 12B in the Z-axis direction. The capacitive electrode pattern 14B is connected directly to the branch line 152B. In this state, the branch line 152B extends through the capacitive electrode pattern 14B. The capacitive coupling portion provided for the feed point 122B and configured as described above provides parallel plate capacitance where part of the dielectric layer 20 is sandwiched between the capacitive electrode pattern 14B and a region being part of the feeding conductor pattern 12B and extending along the periphery of the cavity 123B. Thus, capacitive coupling may be provided between the feed point 122B and the branch line 152B without necessarily impairing the compactness of (or the area savings achieved by) the patch antenna 10B.

Owing to the line length difference $L_B$, which is the difference between the length of the branch line 151B and the length of the branch line 152B, the phase difference between radio-frequency signals lying in the first frequency band and respectively directed to the feed points 111B and 112B of the feeding conductor pattern 11B may be set so that these radio-frequency signals are substantially in antiphase to each other. Owing to the line length difference $L_B$ and the capacitive value of the capacitive coupling portion, the phase difference between radio-frequency signals lying in the second frequency band and respectively directed to the feed points 121B and 122B of the feeding conductor pattern 12B may be set so that these radio-frequency signals are substantially in antiphase to each other.

With the feed line 15B being configured as described above, radio-frequency signals directed to the feed points 111B, 112B, 121B, and 122B may be transmitted through two branch lines, namely, the branch lines 151B and 152B, and the phase difference between radio-frequency signals lying in the first frequency band and respectively directed to the feed points 111B and 112B of the feeding conductor pattern 11B and the phase difference between radio-frequency signals lying in the second frequency band and respectively directed to the feed points 121B and 122B of the feeding conductor pattern 12B may be individually set.

As illustrated in FIG. 10B, the feed line 15C is provided in the dielectric layer 20 and includes branch lines 151C and 152C branching from a branch point 150C. The feed line 15C extends from a connection node on the RFIC 3 to the feed points 111C and 112C. The branch line 151C extends from the branch point 150C to the feed point 111C, and the branch line 152C extends from the branch point 150C to the feed point 112C. The configuration associated with the feeding to the feed points 111C, 112C, 121C, and 122C through the feed line 15C is identical to the configuration associated with the feeding to the feed points 111B, 112B, 121B, and 122B through the feed line 15B and will not be further elaborated here.

As illustrated in FIGS. 10A and 10B, the capacitive coupling portion for the feed point 122C includes a cavity 123C, a capacitive electrode pattern 14C, and the feeding conductor pattern 12B. The configuration of the capacitive coupling portion for the feed point 122C is identical to the configuration of the capacitive coupling portion for the feed point 122B and will not be further elaborated here.

With the feed line 15C being configured as described above, radio-frequency signals directed to the feed points 111C, 112C, 121C, and 122C may be transmitted through two branch lines, namely, the branch lines 151C and 152C, and the phase difference between radio-frequency signals lying in the first frequency band and respectively directed to the feed points 111C and 112C of the feeding conductor pattern 11B and the phase difference between radio-frequency signals lying in the second frequency band and respectively directed to the feed points 121C and 122C of the feeding conductor pattern 12B may be individually set.

Consequently, each of the feeding conductor patterns 11B and 12B may be fed with two sets of substantially antiphase radio-frequency signals. The patch antenna 10B may thus be compact and enables radiation of radio waves in one frequency band that are polarized in two directions orthogonal to each other and radiation of radio waves in another frequency band that are polarized in two directions orthogonal to each other while achieving good symmetry of directivity and a high level of cross-polarization discrimination.

The configuration of the capacitive coupling portion for the feed point 122B and the configuration of the capacitive coupling portion for the feed point 122C are identical to the configuration of the capacitive coupling portion 140 for the feed point 122 in Embodiment 1. Alternatively, these configurations may be identical to the configuration of the capacitive coupling portion 140A for the feed point 122A in Embodiment 2.

The configuration of the patch antenna 10B according to the present embodiment has been described so far. Specifically, the feed points 111B and 112B of the feeding conductor pattern 11B are fed directly through the feed line 15B, the feed point 121B of the feeding conductor pattern 12B is fed directly through the feed line 15B, and the feed point 122B of the feeding conductor pattern 12B is fed capacitively through the feed line 15B. The feed points 111C and 112C of the feeding conductor pattern 11B are fed directly through the feed line 15C, the feed point 121C of the feeding conductor pattern 12B is fed directly through the feed line 15C, and the feed point 122C of the feeding conductor pattern 12B is fed capacitively through the feed line 15C. Nevertheless, it is only required that either one of the two distinctive lines, namely, the feed line 15B or 15C be included in the patch antenna 10B according to the present embodiment. For example, the feed point 122B or 122C of the feeding conductor pattern 12B may be fed by direct feeding instead of being fed capacitively through the capacitive coupling portion.

Embodiment 4

The configurations of the patch antennas in which the feed points of the first feeding conductor are fed by direct feeding have been described so far in Embodiments 1 to 3. In the present embodiment, meanwhile, a configuration of a patch antenna in which the feed points of the first feeding conductor are fed by capacitive feeding will be described.

[4.1 Configuration of Patch Antenna]

Figure 11:
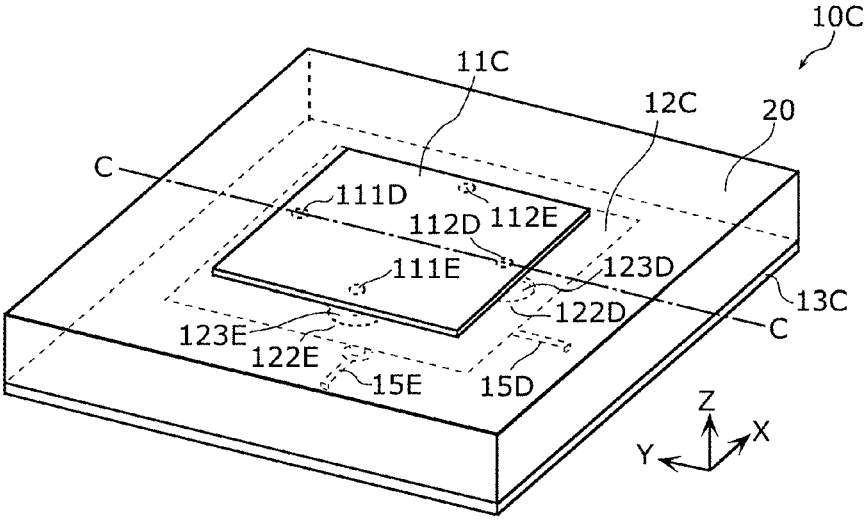
FIG. 11 is an external perspective view of a patch antenna according to Embodiment 4.
Figure 12A:
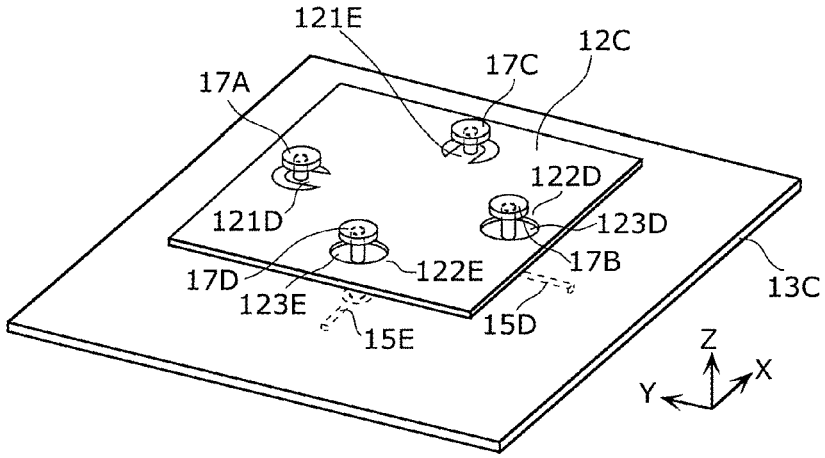
FIG. 12A is a perspective view of the patch antenna according to Embodiment 4, illustrating principal part thereof except for a first feeding conductor.
Figure 12B:
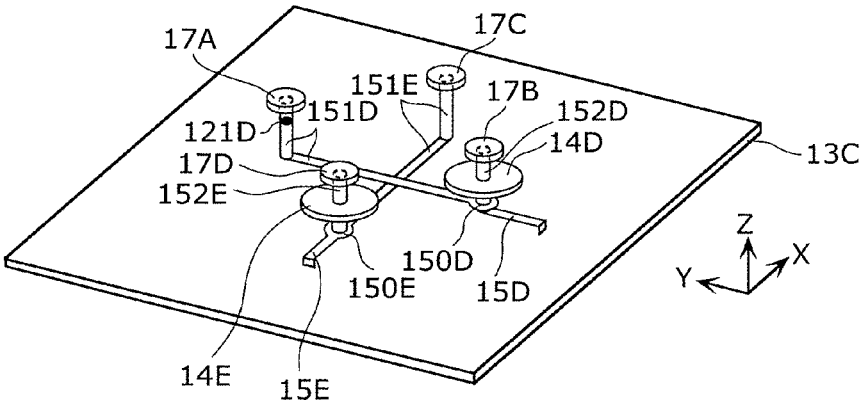
FIG. 12B is a perspective view of the patch antenna according to Embodiment 4, illustrating principal part thereof except for the first feeding conductor and a second feeding conductor.
Figure 12C:
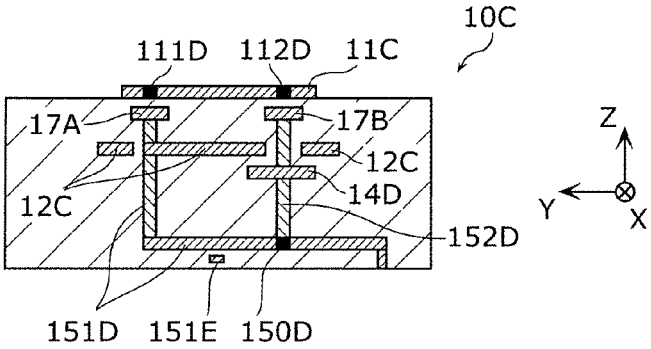
FIG. 12C is a sectional view of the patch antenna according to Embodiment 4.

FIG. 11 is an external perspective view of a patch antenna 10C according to Embodiment 4. FIG. 12A is a perspective view of the patch antenna 10C according to Embodiment 4, illustrating principal part thereof except for a feeding conductor pattern 11C and the dielectric layer 20. FIG. 12B is a perspective view of the patch antenna 10C according to Embodiment 4, illustrating principal part thereof except for the feeding conductor pattern 11C, a feeding conductor pattern 12C, and the dielectric layer 20. FIG. 12C is a sectional view of the patch antenna 10C according to Embodiment 4. Specifically, FIG. 12C is a sectional view of the patch antenna 10C taken along line C-C in FIG. 11 and in the Z-axis negative direction. A ground conductor pattern 13C is not illustrated in FIG. 12C, with emphasis on clarifying the relative arrangement of the feeding conductor patterns 11C and 12C, capacitive electrode patterns 14D, 17A, and 17B, and branch lines 151D and 152D.

As illustrated in FIG. 11, the patch antenna 10C includes the dielectric layer 20, the ground conductor pattern 13C, the feeding conductor patterns 11C and 12C, and feed lines 15D and 15E. The patch antenna 10C according to the present embodiment differs from the patch antenna 10B according to Embodiment 3 in that the patch antenna 10C involves a configuration where the feed points of the first feeding conductor are fed by capacitive feeding instead of being fed by direct feeding. Configurations common to the patch antenna 10C according to the present embodiment and the patch antenna 10B according to Embodiment 3 will be omitted from the following description, which will be given while focusing on distinctive configurations in the present embodiment.

As illustrated in FIG. 11, the feeding conductor pattern 11C is a first feeding conductor lying in a plane and is disposed on the dielectric layer 20 in a manner so as to face (be substantially parallel to) the ground conductor pattern 13C. The feeding conductor pattern 11C has a feed point 111D (a first feed point) and a feed point 112D (a second feed point), which are opposite to each other with respect to the center point of the feeding conductor pattern 11C when the feeding conductor pattern 11C is viewed in plan (in the direction from the Z-axis positive side to the Z-axis negative side). The feed points 111D and 112D are part of the feeding conductor pattern 11C and are regions closer than any other region of the feeding conductor pattern 11C to the feed line 15D. The feeding conductor pattern 11C also has a feed point 111E (a fifth feed point) and a feed point 112E (a sixth feed point), which are opposite to each other with respect to the center point of the feeding conductor pattern 11C when the feeding conductor pattern 11C is viewed in plan. The feed points 111E and 112E are part of the feeding conductor pattern 11C and are regions closer than any other region of the feeding conductor pattern 11C to the feed line 15E. When the feeding conductor pattern 11C is viewed in plan, an imaginary line connecting the feed point 111E to the feed point 112E is orthogonal to an imaginary line connecting the feed point 111D to the feed point 112D.

As illustrated in FIG. 12A, the feeding conductor pattern 12C is a second feeding conductor lying in a plane and is disposed in the dielectric layer 20 in a manner so as to face (be substantially parallel to) the ground conductor pattern 13C and the feeding conductor pattern 11C. The feeding conductor pattern 12C has a feed point 121D (a third feed point) and a feed point 122D (a fourth feed point), which are opposite to each other with respect to the center point of the feeding conductor pattern 12C when the feeding conductor pattern 12C is viewed in plan (in the direction from the Z-axis positive side to the Z-axis negative side). The feed point 121D is a point on the feeding conductor pattern 12C at which the feed line 15D intersects the feeding conductor pattern 12C. The feed point 122D is part of the feeding conductor pattern 12C and is a region closer than any other region of the feeding conductor pattern 12C to the feed line 15D. The feeding conductor pattern 12C also has a feed point 121E (a seventh feed point) and a feed point 122E (an eighth feed point), which are opposite to each other with respect to the center point of the feeding conductor pattern 12C when the feeding conductor pattern 12C is viewed in plan. The feed point 121E is a point on the feeding conductor pattern 12C at which the feed line 15E intersects the feeding conductor pattern 12C. The feed point 122E is part of the feeding conductor pattern 12C and is a region closer than any other region of the feeding conductor pattern 12C to the feed line 15E. When the feeding conductor pattern 12C is viewed in plan, an imaginary line connecting the feed point 121E to the feed point 122E is orthogonal to an imaginary line connecting the feed point 121D to the feed point 122D.

The feed points 111D and 112D of the feeding conductor pattern 11C and the feed points 121D and 122D of the feeding conductor pattern 12C are off-center in the Y-axis direction. Thus, a first polarization direction of the feeding conductor patterns 11C and 12C coincides with the Y-axis direction, and the polarization plane of the feeding conductor patterns 11C and 12C coincides with the Y-Z plane.

The feed points 111E and 112E of the feeding conductor pattern 11C and the feed points 121E and 122E of the feeding conductor pattern 12C are off-center in the X-axis direction. Thus, a second polarization direction of the feeding conductor patterns 11C and 12C coincides with the X-axis direction, and the polarization plane of the feeding conductor patterns 11C and 12C coincides with the X-Z plane.

As illustrated in FIG. 12C, the feed point 111D of the feeding conductor pattern 11C is fed capacitively through the capacitive electrode pattern 17A provided to an end portion of the branch line 151D. As illustrated in FIG. 12C, the feed point 112D of the feeding conductor pattern 11C is fed capacitively through the capacitive electrode pattern 17B provided to an end portion of the branch line 152D. The feed point 121D of the feeding conductor pattern 12C is fed directly through the feed line 15D (a first feed line), and the feed point 122D of the feeding conductor pattern 12C is fed capacitively through the feed line 15D (the first feed line).

The feed point 111E of the feeding conductor pattern 11C is fed capacitively through a capacitive electrode pattern 17D provided to an end portion of a branch line 152E. The feed point 112E of the feeding conductor pattern 11C is fed capacitively through a capacitive electrode pattern 17C provided to an end portion of a branch line 151E. The feed point 121E of the feeding conductor pattern 12C is fed directly through the feed line 15E (a second feed line), and the feed point 122E of the feeding conductor pattern 12C is fed capacitively through the feed line 15E (the second feed line).

This configuration offers the following advantages. Owing to the feeding through the feed line 15D, first-frequency-band radio waves having the first polarization direction are radiated from the feeding conductor pattern 11C, and second-frequency-band radio waves having the first polarization direction are radiated from the feeding conductor pattern 12C. Owing to the feeding through the feed line 15E, first-frequency-band radio waves having the second polarization direction orthogonal to the first polarization direction are radiated from the feeding conductor pattern 11C, and second-frequency-band radio waves having the second polarization direction are radiated from the feeding conductor pattern 12C. That is, first-frequency-band radio waves polarized in two directions orthogonal to each other may be radiated from the feeding conductor pattern 11C, and second-frequency-band radio waves polarized in two directions orthogonal to each other may be radiated from the feeding conductor pattern 12C.

The configurations of the feed lines 15D and 15E substantially identical to the configurations of the feed lines 15B and 15C in Embodiment 3. The configurations of the feed lines 15D and 15E will be described with a focus on differences between the feed lines 15D and 15E in the present embodiment and the feed lines 15B and 15C in Embodiment 3.

As illustrated in FIGS. 12A and 12B, a capacitive coupling portion for the feed point 122D includes a cavity 123D, the capacitive electrode pattern 14D, and the feeding conductor pattern 12C. The cavity 123D is a first cavity provided in a plane in which the feeding conductor pattern 12C lies. The feeding conductor pattern 12C is not provided in the cavity 123D. The branch line 152D extends through the cavity 123D. The capacitive electrode pattern 14D is an electrode pattern lying in a plane and is disposed in a manner so as to face the feeding conductor pattern 12C in the Z-axis direction. The capacitive electrode pattern 14D is connected directly to the branch line 152D. In this state, the branch line 152D extends through the capacitive electrode pattern 14D. The capacitive coupling portion provided for the feed point 122D and configured as described above provides parallel plate capacitance where part of the dielectric layer 20 is sandwiched between the capacitive electrode pattern 14D and a region being part of the feeding conductor pattern 12C and extending along the periphery of the cavity 123D. Thus, capacitive coupling may be provided between the feed point 122D and the branch line 152D without necessarily impairing the compactness of (or the area savings achieved by) the patch antenna 10C.

As illustrated in FIGS. 12A and 12B, a capacitive coupling portion for the feed point 122E includes a cavity 123E, a capacitive electrode pattern 14E, and the feeding conductor pattern 12C. The configuration of the capacitive coupling portion for the feed point 122E is identical to the configuration of the capacitive coupling portion for the feed point 122D and will not be further elaborated here.

As illustrated in FIGS. 11, 12A, 12B, and 12C, a capacitive coupling portion for the feed point 111D includes the capacitive electrode pattern 17A and the feeding conductor pattern 11C. The capacitive electrode pattern 17A is an electrode pattern lying in a plane and is disposed in a manner so as to face the feeding conductor pattern 11C in the Z-axis direction. The capacitive electrode pattern 17A is connected directly to the end portion of the branch line 151D. The capacitive coupling portion provided for the feed point 111D and configured as described above provides parallel plate capacitance where part of the dielectric layer 20 is sandwiched between the capacitive electrode pattern 17A and the feeding conductor pattern 11C. Thus, capacitive coupling may be provided between the feed point 111D and the branch line 151D without necessarily impairing the compactness of (or the area savings achieved by) the patch antenna 10C.

As illustrated in FIGS. 11, 12A, 12B, and 12C, a capacitive coupling portion for the feed point 112D includes the capacitive electrode pattern 17B and the feeding conductor pattern 11C. The capacitive electrode pattern 17B is an electrode pattern lying in a plane and is disposed in a manner so as to face the feeding conductor pattern 11C in the Z-axis direction. The capacitive electrode pattern 17B is connected directly to the end portion of the branch line 152D. The capacitive coupling portion provided for the feed point 112D and configured as described above provides parallel plate capacitance where part of the dielectric layer 20 is sandwiched between the capacitive electrode pattern 17B and the feeding conductor pattern 11C. Thus, capacitive coupling may be provided between the feed point 112D and the branch line 152D without necessarily impairing the compactness of (or the area savings achieved by) the patch antenna 10C.

As illustrated in FIGS. 11, 12A, and 12B, a capacitive coupling portion for the feed point 111E includes the capacitive electrode pattern 17D and the feeding conductor pattern 11C. The capacitive electrode pattern 17D is an electrode pattern lying in a plane and is disposed in a manner so as to face the feeding conductor pattern 11C in the Z-axis direction. The capacitive electrode pattern 17D is connected directly to an end portion of the branch line 152E. The capacitive coupling portion provided for the feed point 111E and configured as described above provides parallel plate capacitance where part of the dielectric layer 20 is sandwiched between the capacitive electrode pattern 17D and the feeding conductor pattern 11C. Thus, capacitive coupling may be provided between the feed point 111E and the branch line 152E without necessarily impairing the compactness of (or the area savings achieved by) the patch antenna 10C.

As illustrated in FIGS. 11, 12A, and 12B, a capacitive coupling portion for the feed point 112E includes the capacitive electrode pattern 17C and the feeding conductor pattern 11C. The capacitive electrode pattern 17C is an electrode pattern lying in a plane and is disposed in a manner so as to face the feeding conductor pattern 11C in the Z-axis direction. The capacitive electrode pattern 17C is connected directly to an end portion of the branch line 151E. The capacitive coupling portion provided for the feed point 112E and configured as described above provides parallel plate capacitance where part of the dielectric layer 20 is sandwiched between the capacitive electrode pattern 17C and the feeding conductor pattern 11C. Thus, capacitive coupling may be provided between the feed point 112E and the branch line 151E without necessarily impairing the compactness of (or the area savings achieved by) the patch antenna 10C.

Owing to this configuration, each of the feeding conductor patterns 11C and 12C may be fed with two sets of substantially antiphase radio-frequency signals. The patch antenna 10C may thus be compact and enables radiation of radio waves in one frequency band that are polarized in two directions orthogonal to each other and radiation of radio waves in another frequency band that are polarized in two directions orthogonal to each other while achieving good symmetry of directivity and a high level of cross-polarization discrimination.

The patch antenna 10C according to the present embodiment can be adopted in such a case where capacitive feeding is advantageously employed to effect antenna matching. When the feeding conductor pattern 11C geared to the higher frequency range is fed by capacitive feeding, the feeding conductor patterns 11C and 12C are loosely coupled to each other, thus eliminating or reducing the possibility that antenna characteristics associated with the feeding conductor patterns 11C and 12C will degrade.

Other Embodiments

The antenna element, the antenna module, and the communication device according to the present disclosure are not limited to those described so far in Embodiments 1 to 4. The present disclosure embraces other embodiments implemented by varying combinations of constituent components of the embodiment above, modifications achieved through various alterations to the embodiment above that may be conceived by those skilled in the art within a range not departing from the spirit of the present disclosure, and various types of apparatuses including the antenna element, the antenna module, and the communication device according to the present disclosure.

For example, the antenna element according to the present disclosure may include a "notch antenna" or a "dipole antenna" in addition to the patch antenna described in any one of the embodiments above.

The patch antennas according to Embodiments 1 to 4 are also applicable to Massive MIMO systems. One of up-and-coming radio transmission techniques for the fifth-generation mobile communication system (5G) is a combination of Phantom Cell and a Massive MIMO system. Phantom Cell refers to a network architecture involving separation between a data signal that is to be transmitted by high-speed data communications and a control signal that is to be transmitted to attain stability of communication between a macro cell using a lower frequency band and a small cell using a higher frequency band. The individual cells constituting the Phantom Cell are provided with their respective Massive MIMO antenna devices. Such a Massive MIMO system is a technique for improving transmission quality in, for example, millimeter-wave bands, where the directivity of patch antennas is controlled through control of signals transmitted from the individual patch antennas. A large number of patch antennas are included in the Massive MIMO system, which in turn enables formation of sharply directional beams. Forming highly directional beams is advantageous in that radio waves in high frequency bands may be transmitted over a somewhat long distance and that inter-cell interference may be reduced to achieve a high degree of frequency utilization efficiency.

Although the patch antennas described in Embodiments 1 to 4 include their respective dielectric layers, the patch antenna according to the present disclosure may be made of sheet metal instead of including a dielectric layer. An antenna device may include a plurality of patch antennas, each of which is configured as described above. The patch antennas may be provided on or in the same dielectric layer. Furthermore, the patch antennas may be provided on or in the same substrate. Alternatively, one or more of the patch antennas may be provided on or in another member, such as a housing.

INDUSTRIAL APPLICABILITY

The present disclosure may be widely used as an antenna element that has multi-band features and may be included in a communication apparatus geared to a system, such as a millimeter-wave band mobile communication system or a Massive MIMO system.

REFERENCE SIGNS LIST

1, 1A antenna module
2 baseband signal processing circuit (BBIC)
3 RF signal processing circuit (RFIC)
4 array antenna
5 communication device
10, 10A, 10B, 10C patch antenna

11, 11A, 11B, 11C, 12, 12A, 12B, 12C feeding conductor pattern
13, 13A, 13B, 13C ground conductor pattern
14, 14B, 14C, 14D, 14E, 17A, 17B, 17C, 17D capacitive 15 electrode pattern
15, 15A, 15B, 15C, 15D, 15E feed line
16, 16A connection node
20 dielectric layer
31A, 31B, 31C, 31D, 33A, 33B, 33C, 33D, 37 switch
32AR, 32BR, 32CR, 32DR low-noise amplifier
32AT, 32BT, 32CT, 32DT power amplifier
34A, 34B, 34C, 34D attenuator
35A, 35B, 35C, 35D phase shifter
36 signal combiner/splitter
38 mixer
39 amplifier circuit
111, 111A, 111B, 111C, 111D, 111E, 112, 112A, 112B, 112C, 112D, 112E, 121, 121A, 121B, 121C, 121D, 121E, 122, 122A, 122B, 122C, 122D, 122E feed point
123B, 123C, 123D, 123E, 141, 141A cavity
140, 140A capacitive coupling portion
150, 150A, 150B, 150C, 150D, 150E branch point
151, 151A, 151B, 151C, 151D, 151E, 152, 152A, 152B, 152C, 152D, 152E branch line

The invention claimed is:

1. An antenna element comprising:
a ground conductor in a first plane of the antenna element, the ground conductor having a ground potential;
a first feeding conductor in a second plane of the antenna element facing the ground conductor;
a second feeding conductor in a third plane of the antenna element facing the ground conductor; and
a first feed line through which radio-frequency signals are transmitted to the first and second feeding conductors, wherein:
the first and second feeding conductors are on the same side of the ground conductor, and are different sizes,
the first feeding conductor comprises a first feed point configured to directly feed radio-frequency signals through the first feed line, and a second feed point configured to directly feed radio-frequency signals through the first feed line,
the second feeding conductor comprises a third feed point configured to directly feed radio-frequency signals through the first feed line, and a fourth feed point configured to capacitively feed radio-frequency signals through the first feed line,
as seen in a plan view, the second feed point is located opposite the first feed point with respect to a center of the first feeding conductor, and
as seen in the plan view, the fourth feed point is located opposite the third feed point with respect to a center of the second feeding conductor.

2. The antenna element according to claim 1, wherein:
radio-frequency signals in a first frequency band and substantially in antiphase to each other are respectively transmitted to the first and second feed points through the first feed line, and
radio-frequency signals in a second frequency band and substantially in antiphase to each other are respectively transmitted to the third and fourth feed points through the first feed line, the second frequency band being different than the first frequency band.

3. The antenna element according to claim 2, wherein:
the first frequency band is greater than the second frequency band, and
an electrical length between the first feed point and the second feed point is shorter than an electrical length between the third feed point and the fourth feed point.

4. The antenna element according to claim 2, wherein the first feeding conductor is between the ground conductor and the second feeding conductor.

5. The antenna element according to claim 4, wherein:
the first frequency band is lower than the second frequency band, and
an electrical length between the first feed point and the second feed point is longer than an electrical length between the third feed point and the fourth feed point.

6. The antenna element according to claim 2, wherein:
the first feeding conductor further comprises a fifth feed point and a sixth feed point,
the second feeding conductor further comprises a seventh feed point and an eighth feed point,
the antenna element further comprises a second feed line through which radio-frequency signals are transmitted to the fifth, sixth, seventh, and eighth feed points,
as seen in the plan view, the sixth feed point is located opposite the fifth feed point with respect to the center of the first feeding conductor, and an imaginary line connecting the fifth feed point to the sixth feed point is orthogonal to an imaginary line connecting the first feed point to the second feed point, and
as seen in the plan view, the eighth feed point is located opposite the seventh feed point with respect to the center of the second feeding conductor, and an imaginary line connecting the seventh feed point to the eighth feed point is orthogonal to an imaginary line connecting the third feed point to the fourth feed point.

7. The antenna element according to claim 6, wherein:
the fifth feed point and the sixth feed point are configured to directly feed radio-frequency signals through the second feed line,
the seventh feed point is configured to directly feed radio-frequency signals through the second feed line,
the eighth feed point is configured to capacitively feed radio-frequency signals through the second feed line,
radio-frequency signals in the first frequency band and substantially in antiphase to each other are respectively transmitted to the fifth and sixth feed points through the second feed line, and
radio-frequency signals in the second frequency band and substantially in antiphase to each other are respectively transmitted to the seventh and eighth feed points through the second feed line.

8. The antenna element according to claim 1, further comprising a dielectric layer, the ground conductor being on the dielectric layer, and the first and second feeding conductors being on or in the dielectric layer, wherein:
the first feed line is in the dielectric layer and comprises a first branch line and a second branch line that branch from each other at a branch point,
the first feed point is connected directly to the first branch line,
the third feed point is connected directly to the first branch line,
the second feed point is connected directly to the second branch line, and
the fourth feed point is electrically connected to the second branch line by capacitive coupling.

9. The antenna element according to claim 1, wherein:
the second feeding conductor is between the ground conductor and the first feeding conductor, and the second feeding conductor comprises a cavity at the fourth feed point, the first feed line extending through the cavity with a clearance between the first feed line and an edge of the cavity.

10. The antenna element according to claim 9, further comprising a capacitive electrode in a fourth plane between the second feeding conductor and the ground conductor, wherein:

as seen in the plan view, the capacitive electrode covers the cavity, the first feed line extends through the capacitive electrode, and the capacitive electrode is connected directly to the first feed line.

11. The antenna element according to claim 9, wherein:

as seen in the plan view, the second and fourth feed points do not overlap, and the first feed line extends along the third plane in the cavity.

12. An antenna comprising a plurality of the antenna elements according to claim 1, the plurality of the antenna elements being arranged in a one-dimensional or a two-dimensional arrangement, wherein the plurality of antenna elements are on or in the same substrate.

13. An antenna module comprising:

the antenna element according to claim 1; and a feeder circuit configured to feed radio-frequency signals to the first and second feeding conductors, wherein:

the first feeding conductor or the second feeding conductor is on a first main surface of a dielectric layer, the ground conductor is on a second main surface of the dielectric layer, the second main surface being opposite the first main surface, and the feeder circuit is provided on the second main surface of the dielectric layer.

14. A communication device comprising:

the antenna element according to claim 1; and a radio-frequency (RF) signal processing circuit configured to feed radio-frequency signals to the first and second feeding conductors, wherein the RF signal processing circuit comprises:

a phase-shift circuit configured to shift a phase of the radio-frequency signals, an amplifier circuit configured to amplify the radio-frequency signals, and a switch configured to selectively switch connection of the antenna element between different signal paths through which the radio-frequency signals are transmitted.

15. An antenna element comprising:

a ground conductor in a first plane of the antenna element, the ground conductor having a ground potential;

a first feeding conductor in a second plane of the antenna element facing the ground conductor;

a second feeding conductor in a third plane of the antenna element facing the ground conductor; and a first feed line through which radio-frequency signals are transmitted to the first and second feeding conductors, wherein:

the first and second feeding conductors are on the same side of the ground conductor, and are different sizes, the first feeding conductor comprises a first feed point configured to capacitively feed radio-frequency signals through the first feed line, and a second feed point configured to capacitively feed radio-frequency signals through the first feed line, the second feeding conductor comprises a third feed point configured to directly feed radio-frequency signals through the first feed line, and a fourth feed point configured to capacitively feed radio-frequency signals through the first feed line, as seen in a plan view, the second feed point is located opposite the first feed point with respect to a center of the first feeding conductor, and as seen in the plan view, the fourth feed point is located opposite the third feed point with respect to a center of the second feeding conductor.

16. A communication device comprising:

the antenna element according to claim 15; and a radio-frequency (RF) signal processing circuit configured to feed radio-frequency signals to the first and second feeding conductors, wherein the RF signal processing circuit comprises:

a phase-shift circuit configured to shift a phase of the radio-frequency signals, an amplifier circuit configured to amplify the radio-frequency signals, and a switch configured to selectively switch connection of the antenna element between different signal paths through which the radio-frequency signals are transmitted.

* * * * *